US006065251A

United States Patent [19]

Kindrick

[11] Patent Number: 6,065,251

[45] Date of Patent: May 23, 2000

[54] BATH BENCH

[76] Inventor: Ronald Steven Kindrick, 7355 Birchtree Forest Dr., Houston, Tex. 77088

[21] Appl. No.: 09/092,484

[22] Filed: Jun. 5, 1998

Related U.S. Application Data

[63] Continuation-in-part of application No. 08/673,910, Jul. 1, 1996, abandoned, which is a continuation-in-part of application No. 08/310,914, Sep. 22, 1994, Pat. No. 5,551,100.

[51] Int. Cl.[7] ..... A47K 3/022; E05D 7/10

[52] U.S. Cl. ..... 52/36.4; 52/34; 52/69; 4/578.1; 16/266; 16/268; 108/42; 108/48; 108/157.13; 297/14; 248/240.3

[58] Field of Search ..... 52/34, 35, 36.4, 52/29, 36.5, 36.6, 69; 4/578.1, 579, 590, 236, 240, 242.1; 108/4, 42, 46, 48, 47, 157.13, 157.15, 157.16, 157.18, 159, 158.12, 157.12, 157.1, 152; 248/235, 240, 240.3, 240.4, 250, 224.7, 224.8, 225.11, 225.21; 297/14; 16/260, 265, 266, 268, 269, DIG. 13, DIG. 43, 223, 385, 387

[56] References Cited

U.S. PATENT DOCUMENTS

| | | | |
|---|---|---|---|
| 128,569 | 7/1872 | Vallett | 108/48 |
| 687,371 | 11/1901 | Dreisbach | 248/240.3 X |
| 1,331,635 | 2/1920 | Flaherty | 108/48 |
| 2,315,801 | 4/1943 | Lave | 16/267 |
| 2,813,276 | 11/1957 | Lanza | 4/579 |
| 2,899,688 | 8/1959 | Hopkins | 4/579 |
| 2,965,153 | 12/1960 | Purcell, Sr. | 297/14 X |
| 3,579,668 | 5/1971 | Aronovitz | 4/578.1 |
| 4,123,808 | 11/1978 | Guarrera | 4/447 |
| 4,939,799 | 7/1990 | Van Hovel | 4/578.1 |
| 4,941,218 | 7/1990 | McCartney | 4/579 |
| 5,185,892 | 2/1993 | Mitchell | 4/578.1 |
| 5,475,880 | 12/1995 | Guenther | 4/578.1 |
| 5,551,100 | 9/1996 | Kindrick | 4/578.1 |
| 5,745,953 | 5/1998 | Golden | 16/260 |

FOREIGN PATENT DOCUMENTS

| | | | |
|---|---|---|---|
| 2010338 | 9/1971 | Germany | 108/42 |
| 3246565 | 6/1984 | Germany | 108/48 |

*Primary Examiner*—Laura A. Callo
*Attorney, Agent, or Firm*—John R. Casperson

[57] ABSTRACT

A convenient bathtub and shower seat, adapted for wall surface mounting within a bathtub with shower stall environment, includes a panel member which is pivotally connected to the shower stall wall for up and down pivotal movement between a vertical storage position and a horizontal use position with downward pivotal movement being limited by the bathtub rear and side walls. At least one hinge member affixed to the stall wall surface provides the connection for panel member pivotal movement and removal of panel member for cleaning and disinfecting.

5 Claims, 21 Drawing Sheets

FIG. 20
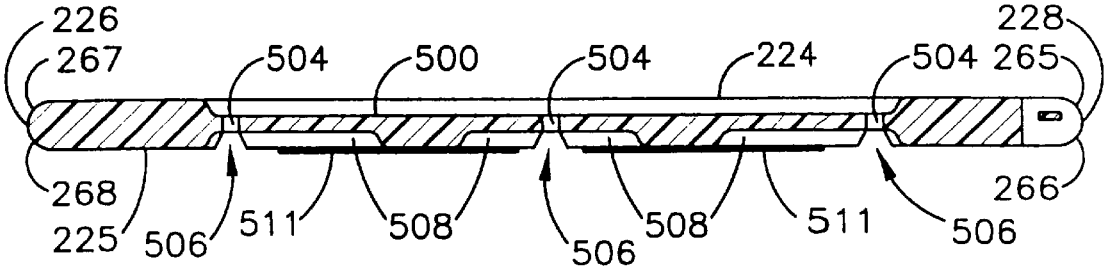
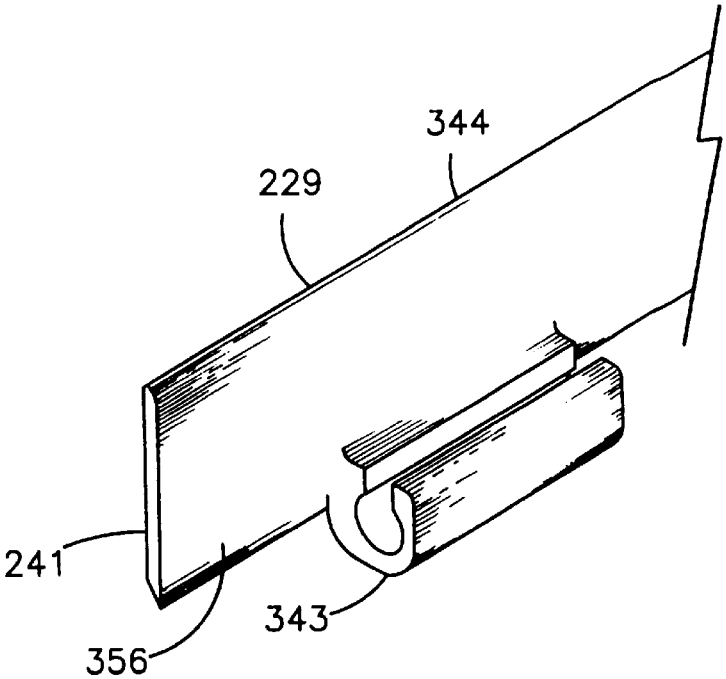
FIG.21

BATH BENCH

This application is a continuation-in-part of application Ser. No. 08/673,910, filed Jul. 1, 1996, now abandoned, which was a continuation in part of serial No. 08/310,914, filed Sept. 22, 1994, now U.S. Pat. No. 5,551,100, issued Sept. 3, 1996.

BACKGROUND OF THE INVENTION

In one aspect, the present invention is directed to a convenient seating unit adapted to support a person in a sitting position while in a bathtub with shower stall environment. In another aspect, the invention relates to certain components suitable for use in such a unit.

Whereas bathing or showering is a daily routine for most individuals, cleansing or grooming of the lower body and lower extremities can be difficult, uncomfortable or hazardous. Additionally, elderly persons or individuals with health concerns that limit mobility or activities often find bathing a tedious and tiring chore. The common solution for most individuals has been to place a chair or stool within the bathtub. Conventional stools or chairs often run the risk of sliding or tipping over and lack convenience of storage when not in use.

Wall mounted seats for a bathtub with shower stall environment have been previously proposed. However, cost, design, materials and mounting means have made these seating units expensive, unattractive or inaccessible to most individuals. Most seating units are manufactured with materials that are not long term resistant to a damp or wet environment and the combination of design and materials do not provide ease in cleaning or disinfecting. Some seating units must be built into the stall wall during construction or require reconstruction for installation while other seating units, using conventional mounting methods, require structural support from existing walls and cause permanent damage to wall surfaces.

A seating unit which is functional yet easy to install, clean and store would be very desirable.

OBJECTS OF THE INVENTION

Accordingly, a principal object of the present invention is to provide an improved wall mounted seat for a bathtub with shower stall environment.

Another object is to provide an improved seat for a bathtub with shower stall environment, that is simple in design, easy to install, easy to use, rugged in construction, economical to manufacture and efficient in operation.

Another object is to provide an improved seat, for a bathtub with shower stall environment, that provides secure structural support of the seat member which is safe and unable to slide or tip over.

Another object is to provide an improved seat, for a bathtub with shower stall environment, that mounts easily, safely and securely without doing permanent damage to existing walls.

Another object is to provide an improved seat, for a bathtub with shower stall environment, that pivots easily from a compact storage position to a usage position or from a usage position to a compact storage position.

Another object is to provide an improved seat, for a bathtub with shower stall environment, that utilizes materials which are resistant to and wear well in a damp or wet environment.

Another object is to provide an improved seat, for a bathtub with shower stall environment, that is removable and provides ease in cleaning and disinfecting of the entire seating unit, stall walls and bathtub.

SUMMARY OF THE INVENTION

One embodiment of the invention provides a bath bench, which is a highly functional, stylishly designed bath seat for use within a standard bathtub and shower stall environment. The bath bench comprises a seat member and a hinge member. The seat member pivotally connects and interlocks with the hinge member via a hinge tab. This pivotal connection allows the seat member to rotate between a horizontal use position and a vertical seat removal/storage position. The cooperative design between the seat, the hinge tab and the hinge member displaces the weight of the seat member to the upper surface of the bathtub wall when the bath bench is in either the storage or the use position, to minimize stress in the connection of the hinge member and the rear wall of the shower stall, which is preferably an adhesive connection to enable the unit to be installed without tools.

The seat member is preferably manufactured with injection molded polypropylene plastic. Its preferred dimensions are twenty eight inches by eighteen inches by one and one-eighth inches and its weight is preferably less than about five pounds. The seat member preferably has a gradual decline to the center seating surface where drain holes allow water to pass through the seat member and into the bathtub. The drain holes are preferably about one-quarter inch by one-eighth inch to eliminate the possibility of a child injuring his fingers. A slot is preferably provided adjacent to the front edge of the seat member to serve as a handle. A pair of slots are also preferably provided near the front edge of the seat member to accommodate security posts. The rear edge of the seat member encompasses the hinge tabs which are preferably designed with specific attributes to permit the hinge tab entrance or exit into the hinge member only when the seat member is in a vertical position and to provide for hinge tab lockup with the hinge member when the seat member is in the use position to eliminate front to back movement. The back edge of the seat member is also preferably provided with recessed areas near the back edge comer so that the unit can be used without damage a shower curtain. The top surface of the seat member preferably includes a skid resistant finish with all surfaces employing a radius for comfort and esthetics. The underside of the seat member preferably utilizes a ribbing system to provide structural integrity while reducing the weight of the seat member and includes rib intersection radiuses which provide ease in cleaning. Additionally, the bottom surface of the seat member preferably incorporates six rubber-like pads to provide secure footing of the seat member on the upper surface of the bathtub side walls.

The seat member preferably employs two security posts to eliminate side to side movement of the seat member when in the use position. The security posts preferably interlock with grooved mounting plates on the underside of the seat member and lock in place by use of a large plastic screw through the top surface of the seat member. The security posts ends are preferably covered with rubber-like heads that position themselves against the interior bathtub wall when the seat member is in the use position.

The hinge member provides the mechanism for the seat member to lock in the horizontal use position and permits pivotal rotation of the seat member for storage or removal. The hinge member is preferably manufactured from injection molded polystyrene plastic, to promote adhesion with the rear wall with the preferred adhesive. The hinge member is preferably twenty eight and one-quarter inches by two inches by one quarter inch with a weight of less than one pound. The hinge member preferably intentionally extends about one-eighth inch beyond the sides of the seat member so that the seat member is positioned to avoid dragging the side stall wall while pivoting between the storage or use positions. The lower rear and side edge surface of the hinge member are preferably beveled to facilitate installing the hinge member over caulking beads.

The hinge member is preferably installed to the rear shower wall using a double backed adhesive tape. The preferred tape is 3M brand VHB (very high bond) double coated acrylic foam tape. The most preferred tape is 3M VHB 4945, because it provides sufficient adhesive forces so that a pry tool is required to separate the hinge member from the rear wall after a few minutes set time, with total strength being acquired in about 72 hours.

BRIEF DESCRIPTION OF THE DRAWINGS

FIG. 20 is a cross sectional view of the panel member shown in FIG. 17 taken along lines 20—20.

FIG. 21 is a perspective view of an end of the hinge member according to the second embodiment of the invention.

DETAILED DESCRIPTION OF THE PREFERRED EMBODIMENTS

Figure 3:
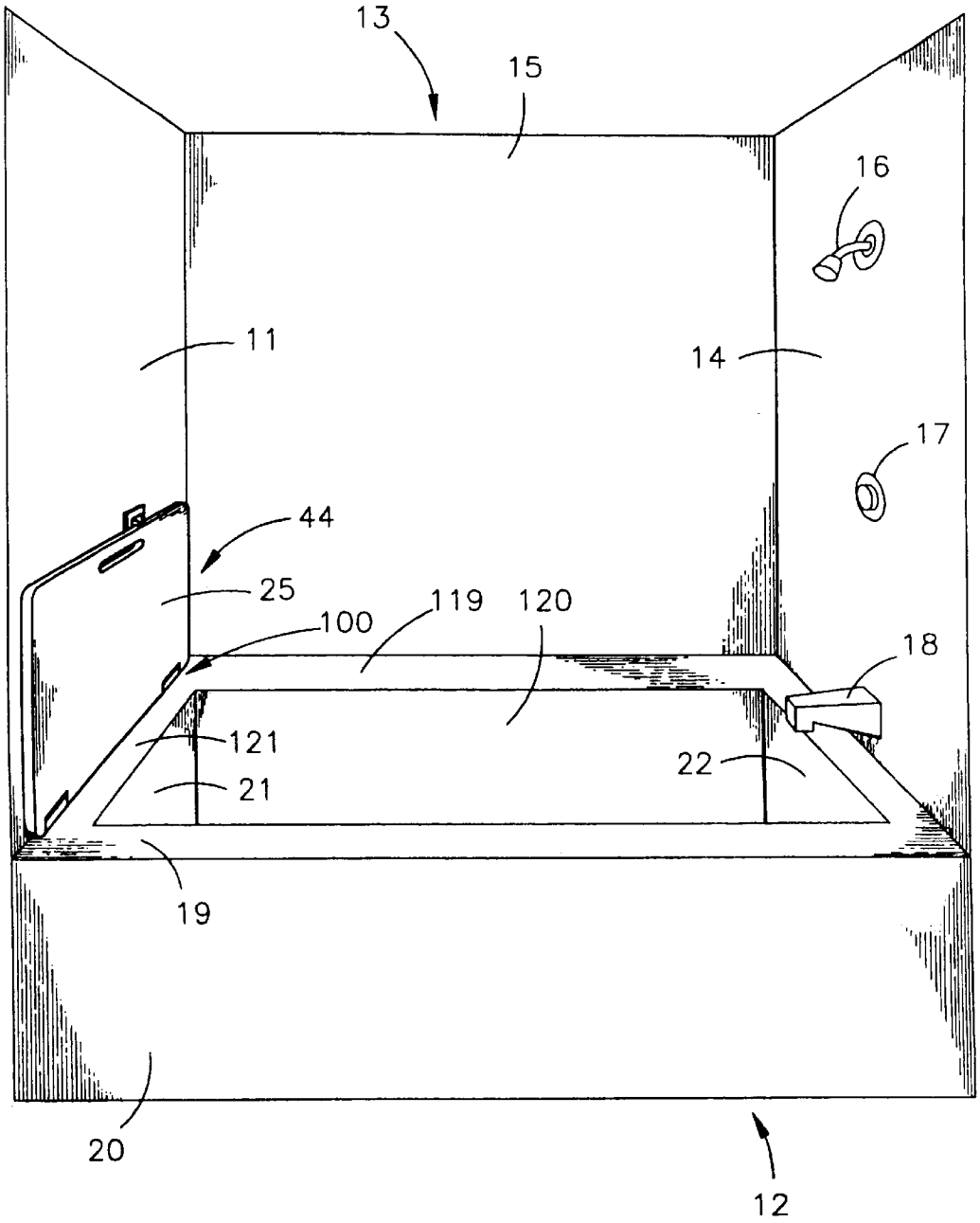
FIG. 3 is a perspective view of the bathtub and shower seat according to one embodiment of the invention, installed in a bathtub with shower stall environment, in the storage position.

In accordance with certain aspects of the invention, there is provided a seating unit 10 for a bathtub 12. The invention is best used with a bathtub 12 as illustrated in FIG. 3 having a rear splash wall 11, such as a bath-shower combination unit 13. The bathtub 12 can be characterized as having a first side wall 20, a second side wall 120, and a back end wall 21 connecting the first side wall with the second side wall. Each of the walls has an upper end 19, 119 and 121 respectively.

The rear splash wall 11 extends upwardly from the upper end 121 of the back end wall 21 of the bathtub. The seating unit 10 comprises a panel member 23 and a means 100 for pivotally connecting the panel member 23 to the rear splash wall 11. The means for pivotally connecting the panel member to the rear splash wall preferably comprises at least one hinge member 29. In a preferred embodiment, the seating unit is also provided with a storage catch member 30 attached to the rear splash wall 11 for retaining the unit in the stored position.

Figure 1:
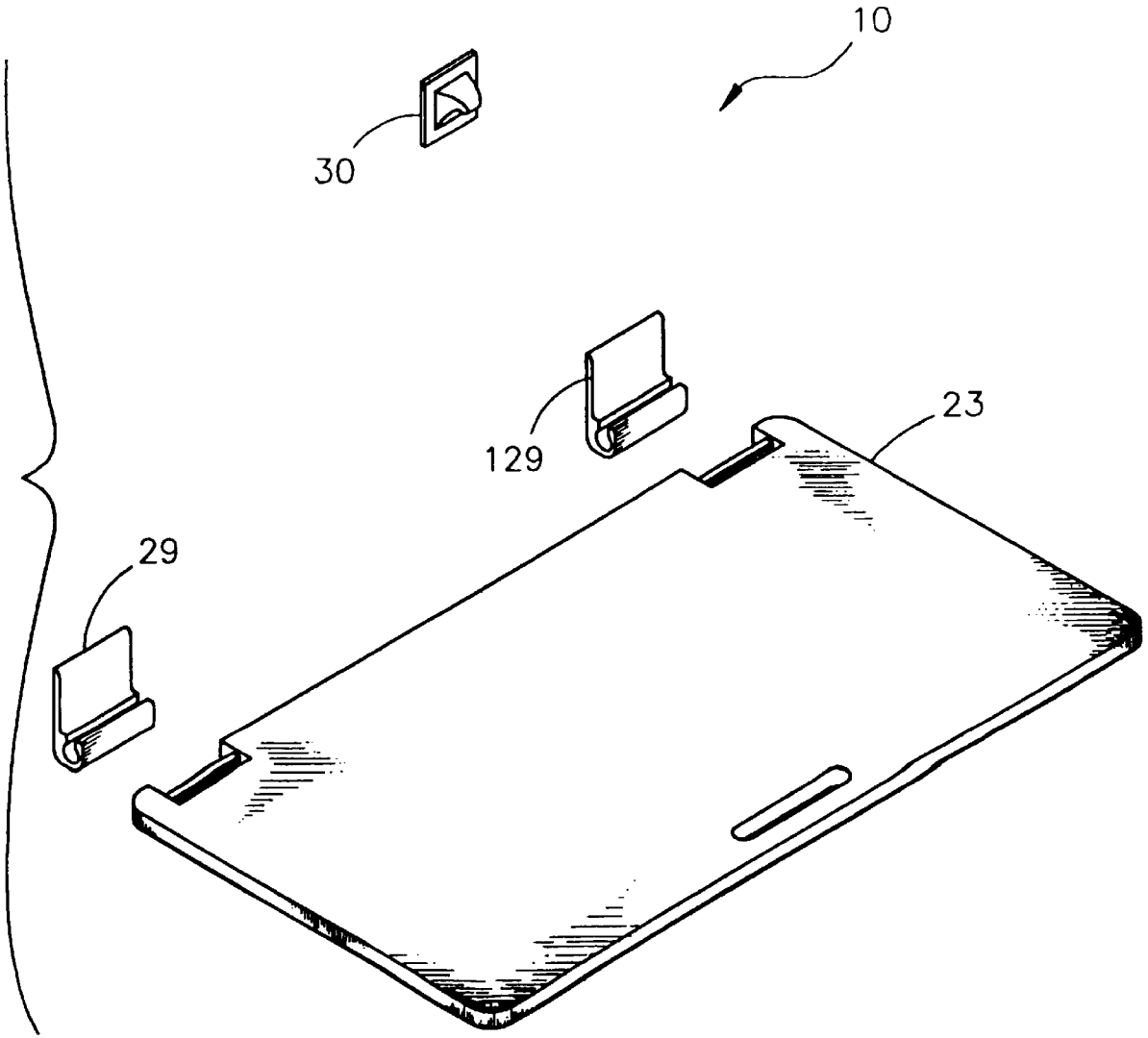
FIG. 1 is an exploded view of the bathtub and shower seat assembly according to one embodiment of the present invention which includes a panel member, the hinge members and the storage catch member.
Figure 2:
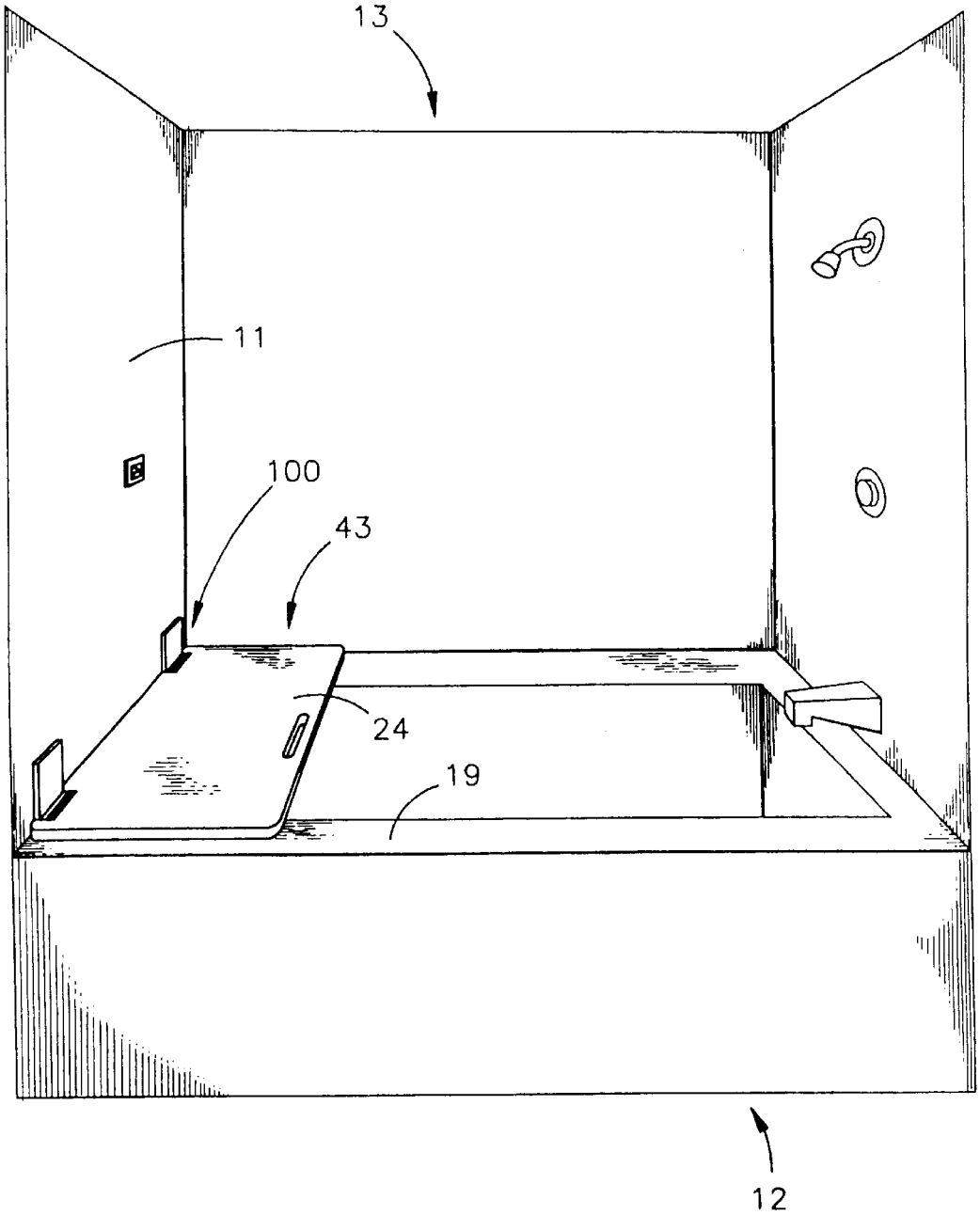
FIG. 2 is a perspective view of the bathtub and shower seat according to one embodiment of the invention, installed in a bathtub with shower stall environment, in the use position.

The bathtub and shower seat assembly 10 of the present invention as illustrated in FIG. 1 includes a panel member 23, hinge members 29 and 129, storage catch member 30 and is further illustrated in FIG. 2 installed onto the rear upright wall surface 11 of a bathtub 12 with shower stall 13. The horizontal usage position 43 of the bathtub and shower seat is illustrated in FIG. 2 and the vertical storage position 44 of the bathtub and shower seat is illustrated in FIG. 3.

Bathtub 12 illustrated in FIGS. 2 & 3 includes a front wall 22, a first side wall 20, a second side wall 120, and a back end wall 21. Shower stall 13 includes a front stall wall 14, rear stall wall 11, side stall wall 15, shower head 16, hot and cold water control 17, and faucet 18.

Figure 4:
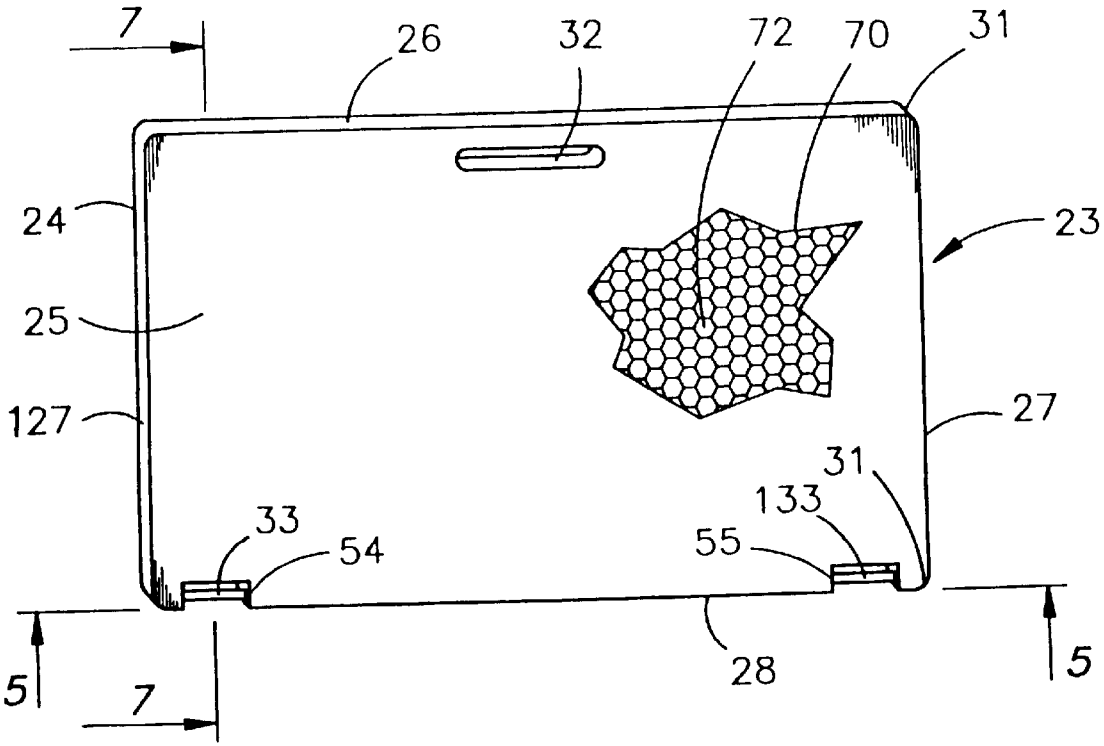
FIG. 4 is a perspective view of the panel member according to an embodiment of the invention, in the storage position, showing the relationship of the handle and hinge pins.
Figure 5:
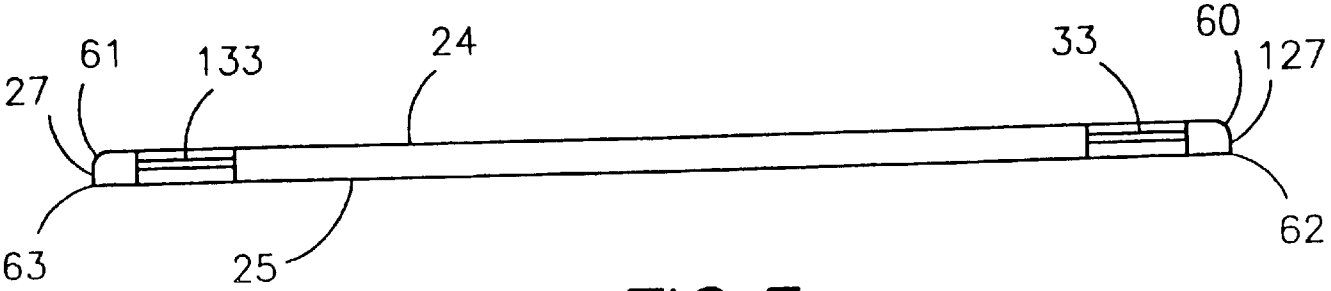
FIG. 5 is a rear perspective view of the panel member taken along lines 5—5 of FIG. 4, showing the design of the end surfaces and the relationship of the hinge pins.
Figure 6:
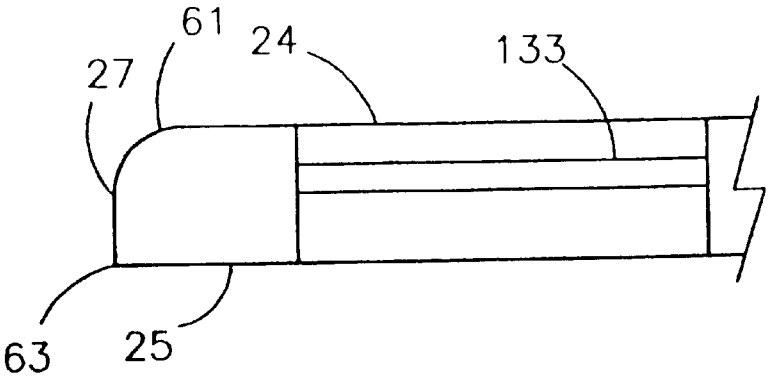
FIG. 6 is a closeup view of the design of the end surface and the relationship of the hinge pin as shown in FIG. 5.
Figure 8:
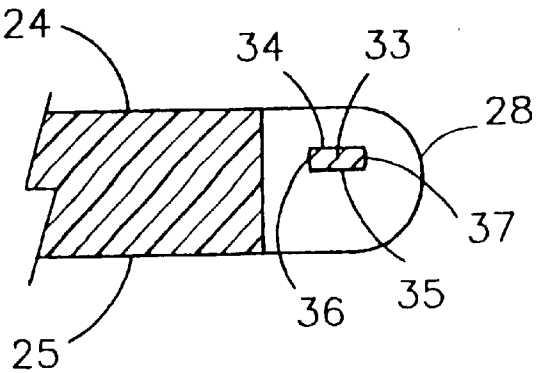
FIG. 8 is a closeup view of the device as shown in FIG. 7 showing the relationship of the hinge pin.

The panel member 23 is generally suitable for forming a bathtub seat. The panel member 23 as illustrated in FIGS. 4 and 5 has a first end 27 and a second end 127. A first generally planar face 24, an opposite second generally planar face 25, a first side surface 28 and an opposite second side surface 26 extending between the first end 27 and the second end 127. A first hinge pin notch 54 and a second hinge pin notch 55 are defined by the first side surface 28. A first hinge pin portion 33 is positioned across the first hinge pin notch 54. A second hinge pin portion 133 is positioned across the second hinge pin notch 55. Each hinge pin portion has a surface forming a first generally cylindrical face 37 as illustrated in FIG. 8 which faces in the same direction as the first side surface 28 of the panel member 23 and a second generally cylindrical face 36 facing in the opposite direction from the first generally cylindrical face 37. Each hinge pin portion also has a first generally planar face 34 which faces in the same direction as the first generally planar face 24 of the panel member 23 and a second generally planar face 35 facing in the opposite direction from the first generally planar face 24.

The panel member 23 as illustrated in FIG. 4 preferably has a first end surface 27 positioned at the first end and a second end surface 127 positioned at the second end. The panel member 23 preferably has a generally rectangular configuration with generally rounded corners 31 connecting the end surfaces with the side surfaces. The panel member 23 has a length as measured between the first end surface 27 and the second end surface 127, a width as measured between the first side surface 28 and the second side surface 26, and a thickness as measured from the first generally planar face 24 to the second generally planar face 25. The length of the panel member is greater than the width and the width is greater than the thickness. The first hinge pin portion 33 and the second hinge pin portion 133 are positioned parallel to the length of the panel member.

The first hinge pin portion 33 and the second hinge pin portion 133 preferably are recessed into their respective hinge pin notches so that they will be positioned between the first generally planar face 24 and the second generally planar face 25, and between the first side surface 28 and the second side surface 26 of the panel member 23. By recessing the hinge pin portion 33 within hinge pin notch 54 and recessing hinge pin portion 133 within hinge pin notch 55, it is possible to use the first side surface 28 and the second generally planar surface 25 of the panel member 23 to support the weight of the panel member 23 and remove stress or weight from the hinge pin portions and hinge members. Recessing the hinge pin portions puts the weight on the second generally planar face 25 of the panel member 23 when in the use position 43 and places the weight on the first side surface 28 of the panel member 23 while in the storage position 44 or while pivoting between the use position and the storage position.

Figure 7:
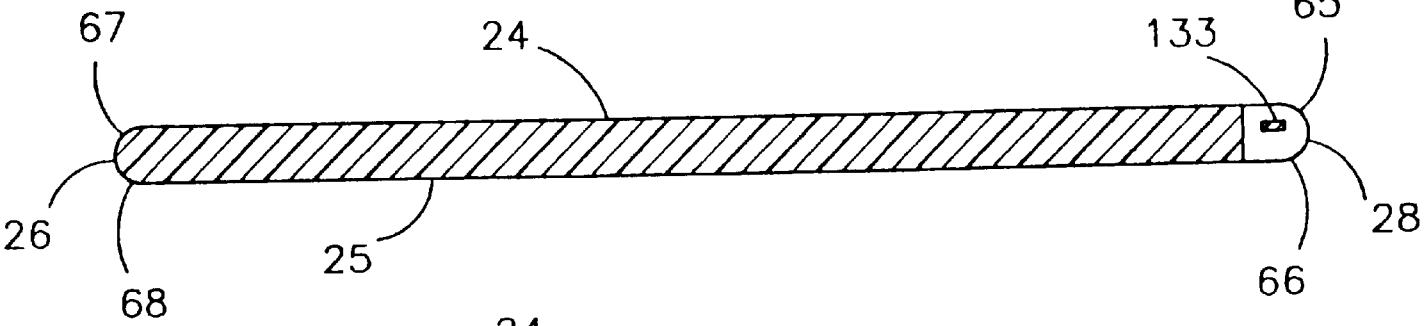
FIG. 7 is a cross sectional view of the panel member taken along lines 7—7 of FIG. 4 showing the relationship of the hinge pin.

The panel member 23 also preferably defines an elongated slot 32 extending from the first generally planar face 24 to the second generally planar face 25. The elongated slot is positioned adjacent to the second side surface 26 and is elongated in the direction of the length of the panel member 23 so that it can be used as a handle. The elongated slot is preferably centrally located between the first end surface 27 and the second end surface 127. The slot forms a handle which serves as a holding place during removal of panel member for cleaning or disinfecting. The slot which serves as the handle has rounded edges and a smooth finish for comfort. It is also preferred that a generally rounded edge 60 as illustrated in FIG. 5 connects the first generally planar face 24 with the first end surface 27, and a generally rounded edge 61 connects the first generally planar face with the second end surface 127. It is further preferred that a generally square edge 62 connects the panel member 23 second generally planar face 25 with the first end surface 27 and a generally square edge 63 connects the second generally planar face 25 with the second end surface 127. This generally square edge maximizes available surface area for contact between the panel member and the upper ends of the bathtub walls when the panel member 23 is in the use position 43. It is still further preferred that a generally rounded edge 65 as illustrated in FIG. 7 connects the panel member 23 first generally planar face 24 with the first side surface 28 and a generally rounded edge 66 connects the second generally planar face 25 with the first side surface 28. This generally rounded edge 66 of the first side surface 28 provides freedom of rotation with respect to and between the panel member 23 and the upper end 121 of the back end wall 21 of the bathtub 12 while providing aesthetic conformity with the hinge members. It is also preferred that a generally rounded edge 67 connects the panel member 23 first generally planar face 24 with the second side surface 26 and a generally rounded edge 68 connects the second generally planar face 25 with the second side surface 26. These generally rounded edges eliminate any sharp edges which could cause discomfort to a user of the device and better conform the second side surface 26 of the panel member 23 for receipt by the storage catch 30.

The panel member can be formed from a wide variety of materials. It is preferred that the panel member be formed partially from plastic, because this permits the hinge pin portions, end surfaces and side surfaces to be injection molded and facilitates providing the first generally planar face 24 and the second generally planar face 25 with a skid resistant surface. A skid resistant or textured non skid upper surface preferably reduces or eliminates slippage or sliding of the user while sitting on the panel member. A textured non skid bottom surface acting in combination with the weight of the user will eliminate slippage or sliding of the panel member when the device is used. Plastic is rugged and sanitary and will endure for a great length of time with little or no care while injection molding of plastic eliminates fabrication or machining requirements and allows for a design which reduces weight and material usage. To reduce weight and expense, the panel member can be formed from a polymer shell 70 encasing a lightweight core material, for example, a core material 72 having a honeycomb configuration or a solid core material, such as foam, which could be injected into the shell. The hinge pin portion can also be formed from plastic, either integral with the panel member or as a separate piece which can be snap fitted or threadably fitted into position.

Figure 9:
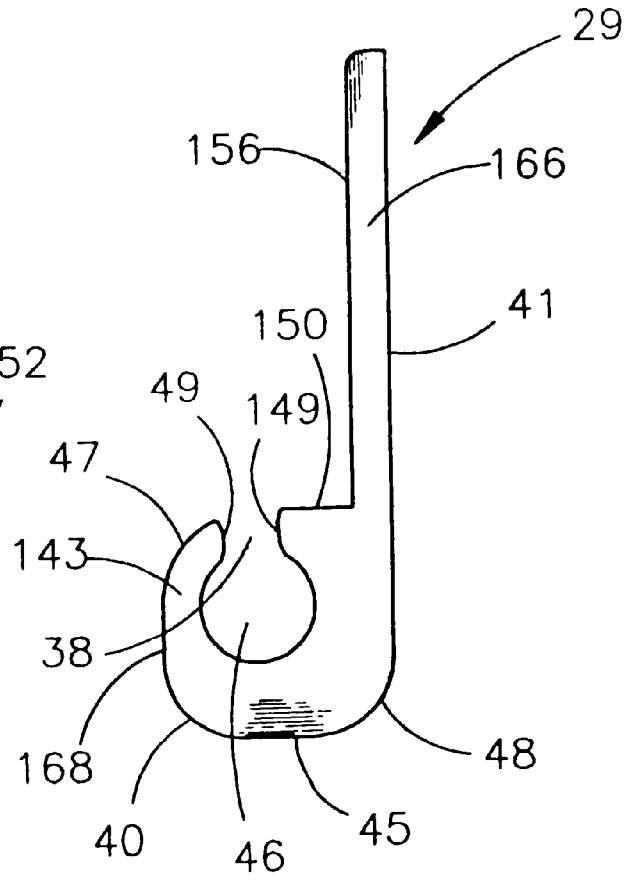
FIG. 9 is a side elevation view of the hinge member according to one embodiment of the invention.
Figure 10:
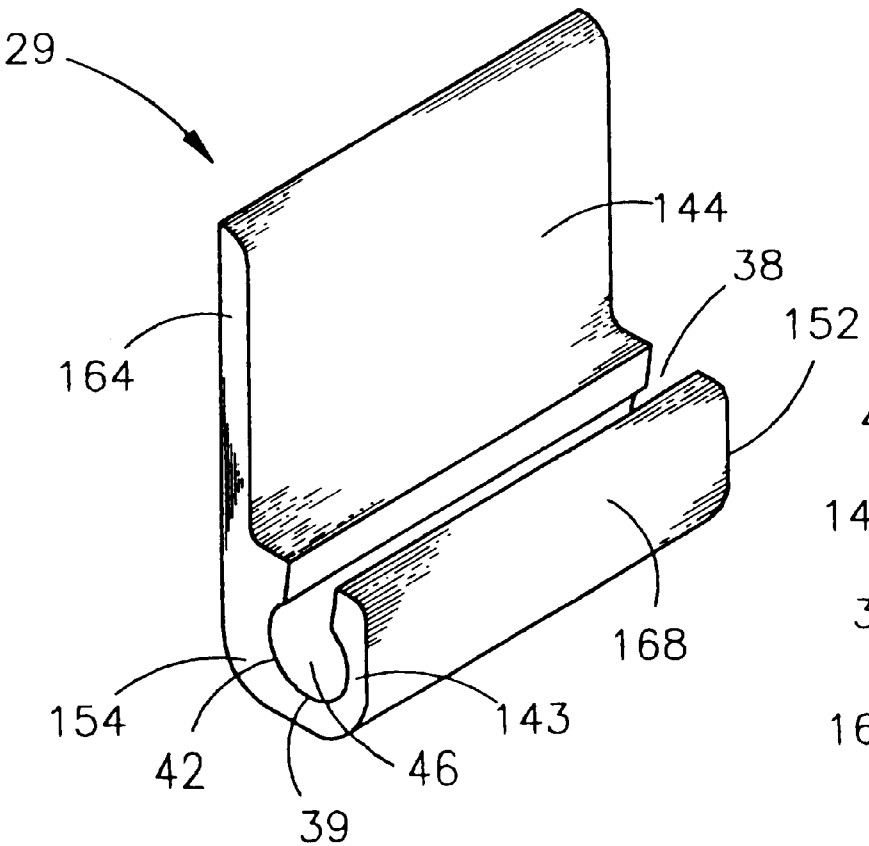
FIG. 10 is a perspective view of the hinge member.
Figure 12:
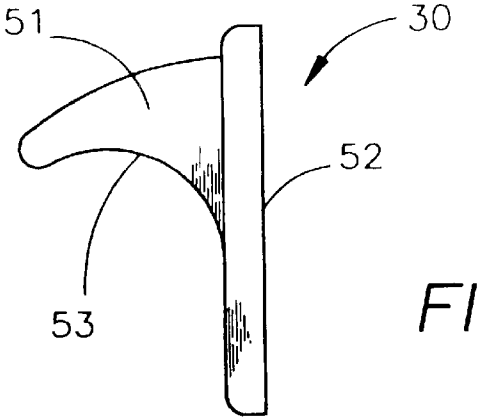
FIG. 12 is a side elevation view of the storage catch member.
Figure 11:
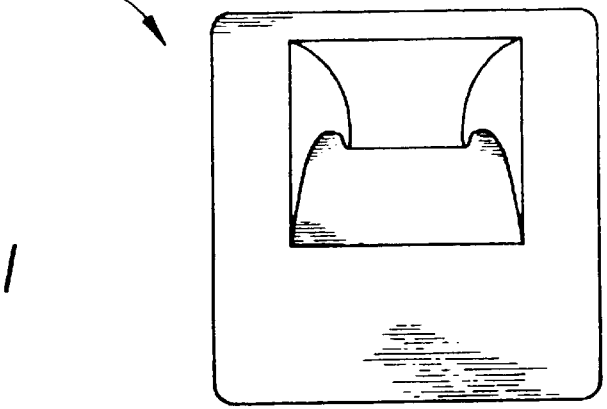
FIG. 11 is a front elevation view of one embodiment of the storage catch member.
Figure 13:
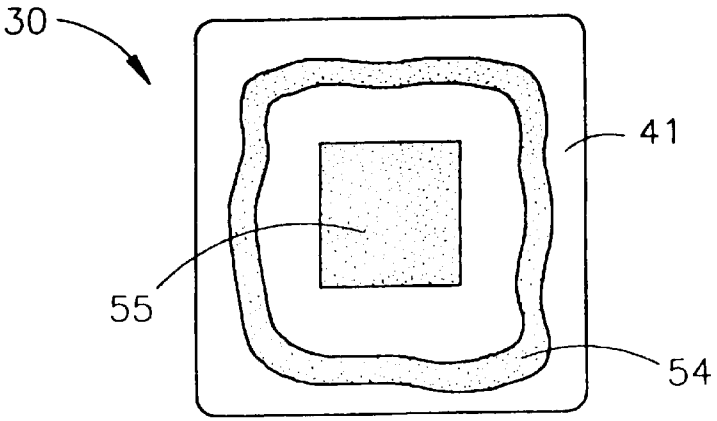
FIG. 13 is a rear elevation view of either the hinge or storage catch member with an adhesive system.

The hinge member 29 as illustrated in FIGS. 9 and 10 is characterized by a hinge pin housing portion 143. The hinge pin housing portion 143 has a first end surface 150, an oppositely facing second end surface 45, a first side surface 152, and an oppositely facing second side surface 154. A hinge pin receiving borehole 46 extends across the width of the hinge pin housing portion 143 from the first side surface 152 to the second side surface 154. The hinge pin receiving borehole 46 has a first diameter. The first end surface 150 of the hinge pin housing portion defines a hinge pin receiving slot 38 leading to the hinge pin receiving borehole 46. The hinge pin receiving slot 38 extends across the width of the hinge pin housing portion 143 from the first side surface 152 to the second side surface 154.

Preferably, the hinge member 29 has a hinge member plate portion 144. The hinge member plate portion 144 has a first generally planar face 156 and a second generally planar face 41 opposite from the first generally planar face 156. The hinge member plate portion extends from the first end surface 150 of the hinge pin housing portion 143. The second generally planar face 41 of the hinge member plate portion and a generally planar face of the hinge pin housing portion together define a generally planar face 41 for mounting the hinge member to the rear splash wall 11. The hinge member plate portion has a first side surface 164 and a second side surface 166 and a width as measured between the first side surface 164 and the second side surface 166. The hinge pin housing portion 143 protrudes from the first face 156 of the hinge member plate portion and extends at least partially across the width of the hinge member plate portion. The hinge member plate portion and the hinge member pin housing portion together define a generally J shaped structure as best shown in FIG. 9. Preferably, the hinge pin housing portion 143 protrudes a sufficient distance to accommodate the hinge pin receiving borehole 46 which is a larger circumference than the hinge pin diameter to allow free rotation of hinge pins 33 and 133.

The hinge pin receiving slot 38 has a width as measured at a right angle to the width of the hinge member plate portion which is less than the diameter of the hinge pin receiving borehole. Preferably, the hinge pin receiving slot is oriented generally radially with respect to the hinge pin receiving borehole 46. More preferably, the hinge pin receiving slot 38 is oriented at an angle in the range of from about 3 degrees to about 30 degrees with respect to the second generally planar face 41 of the hinge member, even more preferably at an angle in the range of from about 5 degrees to about 10 degrees with respect to the generally planar face 41 of the hinge member. The hinge pin receiving borehole surface 39 is preferably spaced apart from a plane defined by the first generally planar face 156 of the hinge member plate portion as well as from the second end surface 45, the first end surface 150, and the front surface 168 of the hinge member 29.

In a particularly preferred embodiment, the hinge pin receiving slot 38 is defined by an outer receiving slot surface 149 and an inner receiving slot surface 49. The hinge pin receiving borehole is defined by a hinge pin receiving borehole surface 39. It is preferred that the inner and outer ends of the hinge pin receiving slot be tapered to facilitate insertion and removal of the hinge pin members 33 and 133 which are part of the panel member 23. In a preferred embodiment, a generally rounded edge connects the first end surface 150 of the hinge pin housing portion with the outer receiving slot surface 149 and a generally rounded edge connects the hinge pin receiving borehole surface 39 with the outer receiving slot surface 149. A generally rounded edge also connects the first end surface 150 of the hinge pin housing portion with the inner receiving slot surface 49 and a generally rounded edge connects the hinge pin receiving borehole surface 39 with the inner receiving slot surface 49. A generally rounded edge 47 also connects a front surface 168 of the hinge pin housing portion 143 with the first end surface 150 to provide freedom of rotation for the panel member 23. A generally rounded edge 40 preferably connects the second end surface 45 with the front surface 168 for aesthetics. A rounded edge 48 connects the second end surface 45 with the generally planar surface 41 to accommodate caulking between bathtub and tile. An imaginary longitudinal axis of the hinge pin receiving borehole 46 is generally parallel to the hinge member second end surface 45 and the second generally planar face 41 of the hinge member so that the hinge pin receiving borehole will be properly positioned with respect to the upper end 121 of the back end wall 21 and the splash wall 11.

In another embodiment of the invention, there is provided a seating unit 10 for a bathtub 12. The seating unit 10 comprises a panel member 23 which can be as described above and a means 100 for pivotally connecting the panel member 23 to the rear splash wall 11. The panel member 23 has a length sufficient to simultaneously contact the upper end 19 of the first side wall 20 and the upper end 119 of the second side wall 120. The means 100 pivotally connects the panel member 23 to the rear splash wall 11 at a location adjacent to the upper end 121 of the back end wall 21, so that the panel member 23 will pivot from a storage position 44 as illustrated in FIG. 3 to a use position 43 as illustrated in FIG. 2.

Preferably, the panel member 23 is adjacent to the rear splash wall 11 when in the storage position 44. When the panel member 23 is in the use position 43, a first end portion of the second generally planar face 25 of the panel member 23 contacts the upper end 19 of the first side wall 20 and a second end portion of the second generally planar face of the panel member 23 contacts the upper end 119 of the second side wall 120. Even more preferably, a first side portion of the second generally planar face 25 of the panel member 23 contacts the upper end 121 of the back end wall 21. Providing the panel member 23 with generally square edges 62 and 63 increases the available contact area between the panel member 23 and the bathtub. The panel member 23 first side surface 28 preferably contacts the upper end 121 of the back end wall 21 when the panel member is in the storage position 44. This contact takes stress or weight off of the hinge members and hinge pin portions. The hinge pin portions are preferably positioned for only incidental contact with the hinge pin receiving borehole surfaces of the hinge members. By providing the panel member 23 with the generally rounded edge 66, smooth movement between the storage position and the use position is facilitated as well as the avoidance of unnecessary stress on the means 100 for pivotally connecting the panel member 23 to the splash wall 11.

The storage catch member 30 is preferably affixed to the rear splash wall 11 to releaseably retain the panel member 23 while in the storage position 44. Preferably, the storage catch member 30 releaseably engages the second side surface 26 of the panel member 23. The storage catch member 30 preferably has an arm portion 51 and a storage catch plate portion 52 and is affixed to the rear splash wall 11 by the storage catch plate portion 52. The storage catch arm portion 51 extends away from the storage catch plate portion 52 and has a generally concave lower surface 53 to receive the second side surface 26 of the panel member 23. It is preferred that the second side surface 26 of the panel member 23 has a generally convex shape with a first radius and the generally concave lower surface 53 of the storage catch arm portion 51 of the storage catch member has a second radius which is larger than the first radius to facilitate the storage catch member performing a latching function. It is further preferred that at least the storage catch arm portion of the storage catch member is formed from a resilient material so that the storage catch arm portion 51 is movable from a storage position to a use position as the panel member 23 moves into and out of the storage position 44 to further assure that the storage catch member 30 will provide a latching function. Plastic is a preferred material of construction for the storage catch member 30.

Preferably, the panel member 23 is secured to the rear splash wall 11 by a first hinge member 29 and a second hinge member 129. The panel member 23 is removable from the first hinge member 29 and the second hinge member 129 when the panel member 23 is oriented in a panel unlock position. The panel unlock position is at a location between the storage position 44 and the use position 43 and coincides with the orientation of the hinge pin receiving slot 38. In the panel unlock position, the generally planar faces 34 and 35 on the hinge pin portions 33 and 133 are aligned with the hinge pin receiving slot 38 in the hinge members 29 and 129 to permit passage through the hinge pin receiving slot 38. Except when in the panel unlock position, the hinge pin portions will not pass through the slot. Desirably, the first hinge pin portion 33 fits loosely in the hinge pin receiving borehole of the first hinge member 29 and the second hinge pin portion 133 fits loosely in the hinge pin receiving borehole of the second hinge member 129 so that the second side surface 28 of the panel member 23 rests against the upper end 121 of the back end wall 21 of the bathtub when the panel member 23 is in the storage position 44. The hinge pins 33 and 133 primarily serve as a guide while the panel member pivots from either the usage or storage position and additionally function as a key, during removal or replacement of the panel member, for entry to and exit from the hinge members. The hinge pin is specifically designed to be non weight bearing. Desirably, the hinge pin portions fit loosely in the hinge pin receiving boreholes of the hinge members to that the weight of the panel members can be removed from the hinges.

When the panel member 23 is in the use position 43, the hinge pin axis is set apart from the second generally planar surface 25 of the panel member 23 further than the distance from the hinge member second end surface 45 to the closest surface 39 of the hinge pin receiving borehole 46 and is set apart from the first side surface 28 of the panel member 23 further than the distance from the hinge member mounting plate portion first generally planar face 156 to the closest surface 39 of the hinge pin receiving borehole 46.

When the panel member 23 is in the storage position 44, the hinge pin axis is set apart from the first generally planar surface 24 of the panel member 23 further than the distance from the hinge member mounting plate portion first generally planar face 156 to the closest surface 39 of the hinge pin receiving borehole 46 and is set apart form the panel member 23 first side surface 28 further than the distance from the hinge member second end surface 45 to the closest surface 39 of the hinge pin receiving borehole 46.

This configuration permits the weight of the panel member 23 to be supported by the upper ends of the bathtub walls. In an embodiment of the invention which has been tested with good results, the hinge portions were formed from 5/16 inch stock and the hinge pin receiving borehole had a diameter of 3/8 inch. The hinge pin receiving slot had a width between the inner slot surface 149 and the out slot surface 149 of about 1/4 inch and the hinge pin portions measured about 7/32 inch from the generally planar face to the generally planar face.

The hinge member 29, the second hinge member 129, and the storage catch member 30 can be affixed to the rear splash wall 11 by a wide variety of techniques. Preferably, they are adhesively affixed to the rear splash wall. It is particularly preferred to utilize double sided tape 55 centrally located in the respective plate portion of the catch member and the hinge members. Even more preferably, the plate portions are further secured by a bead 54 of an adhesive material. Preferably, a solvent-based adhesive material is used. Even more preferably, the adhesive material comprises an adhesive-sealant material because such material fills the gaps and prevents moisture from penetrating between the hinge and storage catch members and the splash wall. Goop brand adhesive sealant has been tested with good results.

Figure 14:
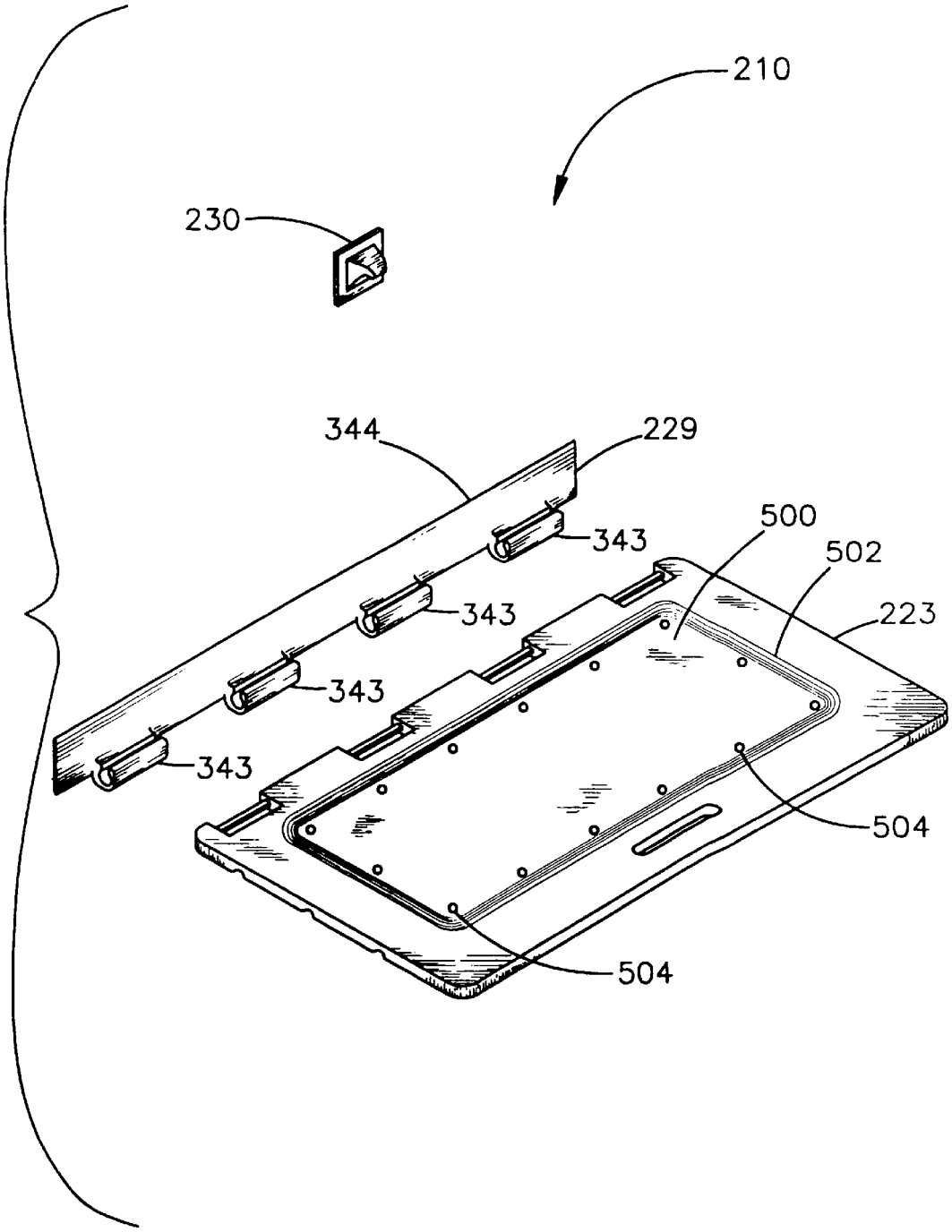
FIG. 14 is an exploded view of the bathtub and shower seat assembly according to a second embodiment of the present invention which includes a panel member, a hinge members and the storage catch member.
Figure 15:
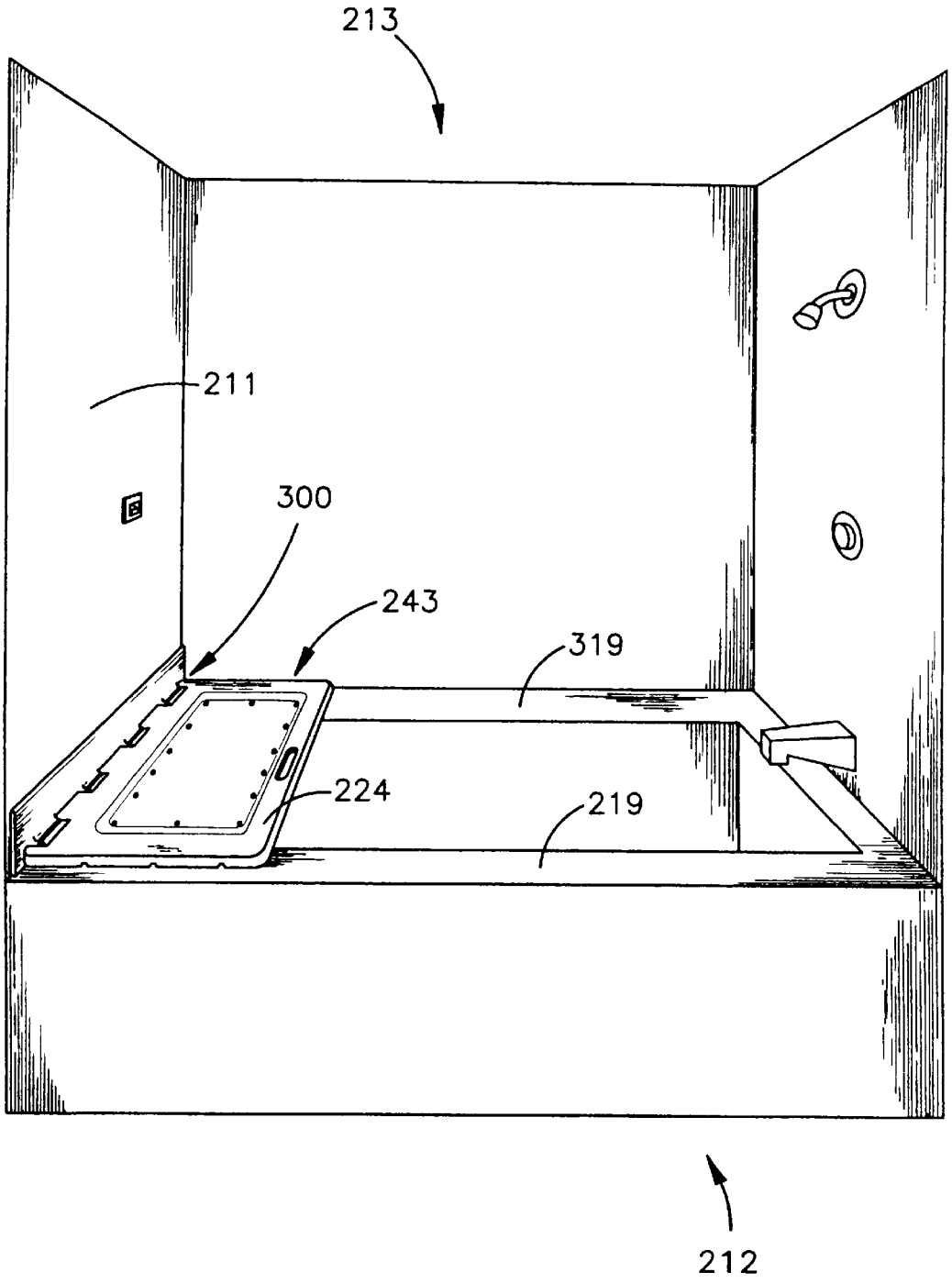
FIG. 15 is a perspective view of the bathtub and shower seat according to the second embodiment of the invention, installed in a bathtub with shower stall environment, in the use position.
Figure 16:
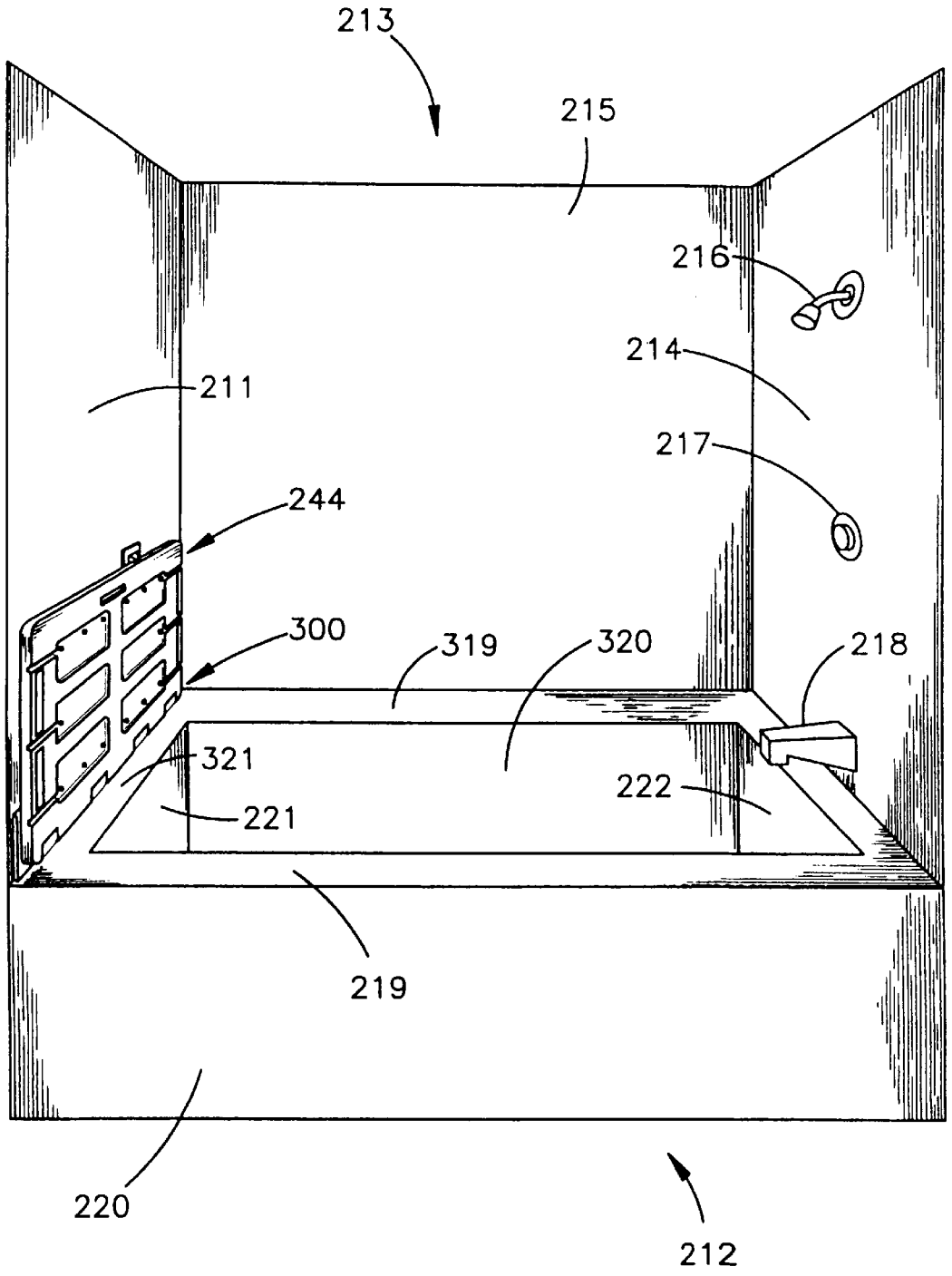
FIG. 16 is a perspective view of the bathtub and shower seat according to the second embodiment of the invention, installed in a bathtub with shower stall environment, in the storage position.

With references to FIGS. 14–21, in accordance with another embodiment of the invention, there is provided a seating unit 210 for a bathtub 212. The invention is best used with a bathtub 212 as illustrated in FIG. 16 having a rear splash wall 211, such as a bath-shower combination unit 213. The bathtub 212 can be characterized as having a first side wall 220, a second side wall 320, and a back end wall 221 connecting the first side wall with the second side wall. Each of the walls has an upper end 219, 319 and 321 respectively. The rear splash wall 211 extends upwardly from the upper end 321 of the back end wall 221 of the bathtub. The seating unit 210 comprises a panel member 223 and a means 300 for pivotally connecting the panel member 223 to the rear splash wall 211. The means for pivotally connecting the panel member to the rear splash wall preferably comprises a hinge member 229. In a preferred embodiment, the seating unit is also provided with a storage catch member 230 attached to the rear splash wall 211 for retaining the unit in the stored position.

The bathtub and shower seat assembly 210 of the present invention as illustrated in FIG. 14 includes a panel member 223, a hinge member 229 and a storage catch member 230 and is further illustrated in FIG. 15 installed onto the rear upright wall surface 211 of a bathtub 212 with shower stall 213. The horizontal usage position 243 of the bathtub and shower seat is illustrated in FIG. 15 and the vertical storage position 244 of the bathtub and shower seat is illustrated in FIG. 16.

Bathtub 212 illustrated in FIGS. 15 and 16 includes a front wall 222, a first side wall 220, a second side wall 320, and a back end wall 221. Shower stall 213 includes a front stall wall 214, rear stall wall 211, side stall wall 215, shower head 216, hot and cold water control 217, and faucet 218.

The panel member 223 is generally suitable for forming a bathtub seat. The panel member 23 as illustrated in FIGS. 17–20 has a first end 227 and a second end 327. A top surface 224, an opposite bottom surface 225, a first side surface 228 and an opposite second side surface 226 extend between the first end 227 and the second end 327. A plurality of hinge pin notches 254 are defined by the first side surface 228. A hinge pin portion 233 is positioned across each of the first hinge pin notches 254. Each hinge pin portion has a surface forming a first generally cylindrical face as previously described with respect to FIG. 8 which faces in the same direction as the first side surface of the panel member 223 and a second generally cylindrical face facing in the opposite direction from the first generally cylindrical face. Each hinge pin portion also has a first generally planar face which faces in the same direction as the top surface 224 of the panel member 223 and a second generally planar face facing in the opposite direction from the top surface 224.

Figure 17:
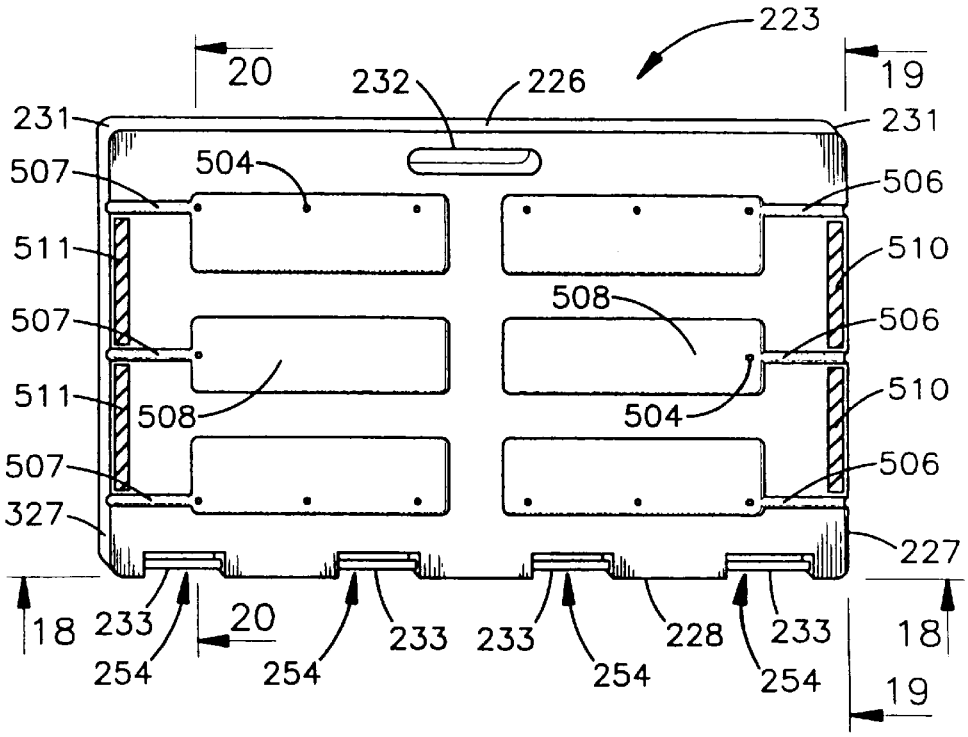
FIG. 17 is a perspective view of the panel member according to the second embodiment of the invention, in the storage position, showing the relationship of the handle and hinge pins and structural details of the lower panel face.

The panel member 223 as illustrated in FIG. 17 preferably has a first end surface 227 positioned at the first end and a second end surface 327 positioned at the second end. The panel member 223 preferably has a generally rectangular configuration with generally rounded comers 231 connecting the end surfaces with the side surfaces. The panel member 223 has a length as measured between the first end surface 227 and the second end surface 327, a width as measured between the first side surface 228 and the second side surface 226, and a thickness as measured from the top surface 224 to the bottom surface 225. The length of the panel member is greater than the width and the width is greater than the thickness. The first hinge pin portions 233 are positioned parallel to the length of the panel member. Preferably, a plurality of hinge pin portions form a part of the panel member, more preferably in the range of from 3 to 6, and most preferably 4.

The hinge pin portions 233 preferably are recessed into their respective hinge pin notches so that they will be positioned between the top surface 224 and the bottom surface 225, and between the first side surface 228 and the second side surface 226 of the panel member 223. By recessing the hinge pin portions 233 within the hinge pin notches 254, it is possible to use the first side surface 228 and the bottom surface 225 of the panel member 223 to support the weight of the panel member 223 and remove stress or weight from the hinge pin portions and hinge member. Recessing the hinge pin portions puts the weight on the second generally planar face 225 of the panel member 223 when in the use position 243 and places the weight on the first side surface 228 of the panel member 223 while in the storage position 244 or while pivoting between the use position and the storage position.

Figure 18:
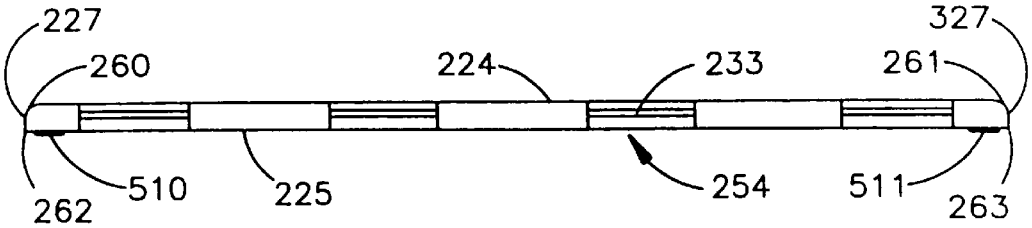
FIG. 18 is a rear perspective view of the panel member taken along lines 18-18 of FIG. 17, showing the design of the end surfaces and the relationship of the hinge pins.
Figure 19:
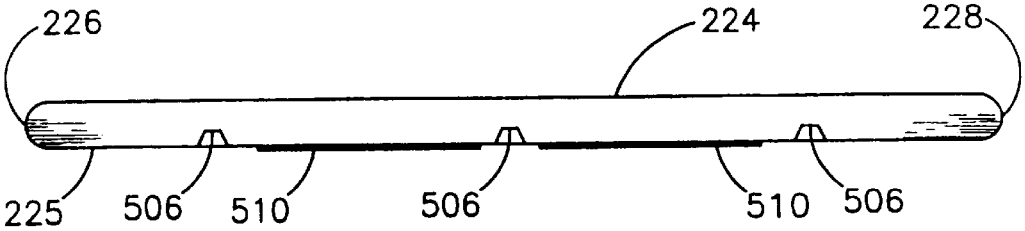
FIG. 19 is an end view of the panel member shown in FIG. 17.

The panel member 223 also preferably defines an elongated slot 232 extending from the top surface 224 to the bottom surface 225. The elongated slot is positioned adjacent to the second side surface 226 and is elongated in the direction of the length of the panel member 223 so that it can be used as a handle. The elongated slot is preferably centrally located between the first end surface 227 and the second end surface 327. The slot forms a handle which serves as a holding place during removal of panel member for cleaning or disinfecting. The slot which serves as the handle has rounded edges and a smooth finish for comfort. It is also preferred that a generally rounded edge 260 as illustrated in FIG. 18 connects the top surface 224 with the first end surface 227, and a generally rounded edge 261 connects the top surface with the second end surface 327. It is further preferred that a generally square edge 262 connects the panel member 223 bottom surface 225 with the first end surface 227 and a generally square edge 263 connects the bottom surface 225 with the second end surface 327. This generally square edge maximizes available surface area for contact between the panel member and the upper ends of the bathtub walls when the panel member 223 is in the use position 243. It is still further preferred that a generally rounded edge 265 as illustrated in FIG. 20 connects the panel member 223 upper surface 224 with the first side surface 228 and a generally rounded edge 266 connects the bottom surface 225 with the first side surface 228. This generally rounded edge 266 of the first side surface 228 provides freedom of rotation with respect to and between the panel member 223 and the upper end 321 of the back end wall 221 of the bathtub 212 while providing aesthetic conformity with the hinge members. It is also preferred that a generally rounded edge 267 connects the panel member 223 top surface 224 with the second side surface 226 and a generally rounded edge 268 connects the bottom surface 225 with the second side surface 226. These generally rounded edges eliminate any sharp edges which could cause discomfort to a user of the device and better conform the second side surface 226 of the panel member 223 for receipt by the storage catch 230.

In a particularly preferred embodiment of the invention, the top surface 224 defines a panel-shaped recess 500 which occupies a substantial portion of the top surface. This recess reduces weight and expense of the panel member as well as providing a more secure seating surface and aesthetically pleasing appearance. The panel shaped recess is preferably generally rectangularly shaped and has a length to width ratio which similar to the length to width ratio of the panel member 223. More preferably, the panel shaped recess 500 has a perimeter 502 and the panel member further defines a plurality of apertures 504 located adjacent to the perimeter of the panel shaped recess and extending from the top surface of the panel shaped recess of the panel member to the bottom surface of the panel member. The apertures provide for drainage.

In a further particularly preferred embodiment, the bottom surface 225 of the panel member 223 defines a plurality of channels 506 extending from the first end surface 227 of the panel member toward the second end surface 327 of the panel member and a plurality of channels 507 extending from the second end surface 327 of the panel member toward the first end surface 227 of the panel member. The channels provide for drainage between the seat and the upper surface of the tub when the unit is in use. Generally speaking, between 2 and about 10 channels are employed at each end. For further reduction in weight and expense, the bottom surface 225 can define a plurality of panel-shaped recesses 508 which occupy a substantial portion of the bottom surface 225. The panel shaped recesses 508 can be rectangular in configuration. As illustrated, each of the channels can lead to a panel shaped recess.

It is preferred to adhere at least a first strip 510 of skid resistant elastomeric material is adhered to the bottom surface 225 of the panel member adjacent to the first end surface 227 and at least a second strip 511 of skid resistant elastomeric material to the bottom surface of the panel member adjacent to the second end surface 327. The elastomeric material aids in reliably positioning the panel member in the use position. Where the panel member defines a plurality of channels extending from the first end of the panel member toward the second end of the panel member and a plurality of channels extending from the second end of the panel member toward the first end of the panel member, the strips can be positioned between the channels.

The hinge member 229 as illustrated in FIGS. 14 and 21 is characterized by a plurality of hinge pin housing portions 343. Preferably, the plurality is in number between 3 and 6, and most preferably 4. Each hinge pin housing portion can be formed as previously described with reference to FIGS. 9 and 10. Preferably, the hinge member 229 has a hinge member plate portion 344. The hinge member plate portion 344 is preferably elongated and flattened and has a longitudinal axis, a first generally planar face 356 and a second, opposite generally planar face 241. The hinge member plate portion is preferably longer than the panel. A plurality of hinge pin housing portions 343 are positioned in spaced apart relationship on the first generally planar face 356 of the hinge member plate portion 344 with each hinge pin receiving borehole being in axial alignment with an adjacent borehole. The end portions of the hinge member plate portion 344, defined as the portions of the hinge pin plate portion which protrude past the outermost hinge pin housing portions 343, are preferably longer than the corresponding end portions of the panel member 223, defined as the portions of the panel member which protrude past the outermost hinge pins 233. When the hinge member is assembled with the panel member, this relationship causes the end portions of the hinge member plate portion to protrude past the ends of the panel member, insuring that the panel member will not drag on the back wall 215 of the shower stall during use.

Whereas the bathtub and shower seat of the invention has been shown and described in connection with the preferred embodiments thereof it is understood that many modifications, substitutions and additions may be made which are with in the intended broad scope of the appended claims. For example whereas the hinge members and storage catch are mounted to the wall surface with adhesive, they could be mounted to wall surface with screws or bolts. Whereas the panel member hinges to the rear and stores against the rear wall it could hinge to the side and store against the side wall. Whereas injection molded plastic is the preferred material and manufacturing method, plastic, wood, aluminum, steel or other suitable materials could be machined or fabricated and substituted if desired.

Figure 22:
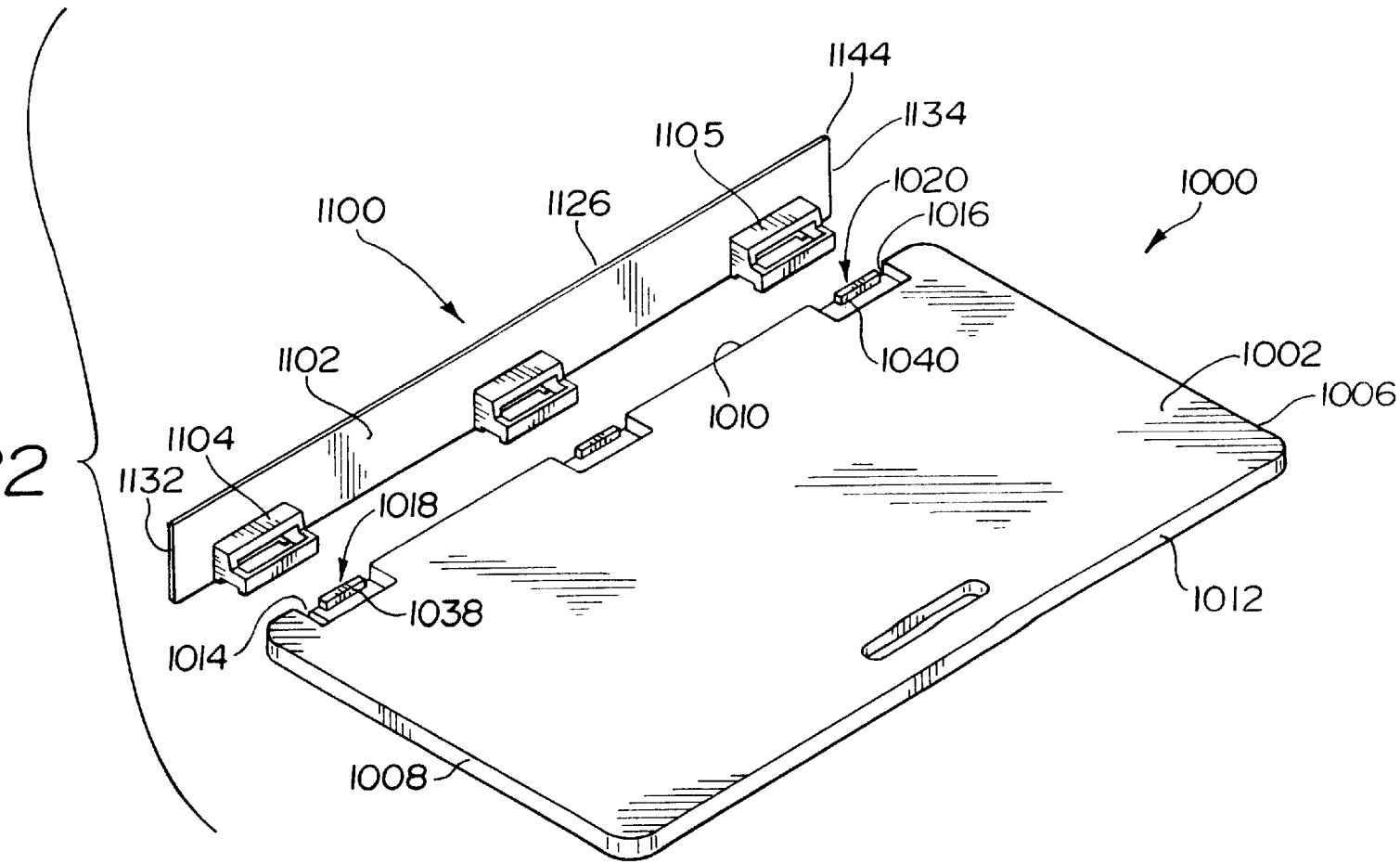
FIG. 22 is an exploded view of the bathtub and shower seat assembly according to a third embodiment of the present invention which includes a panel member and a hinge member.
Figure 24:
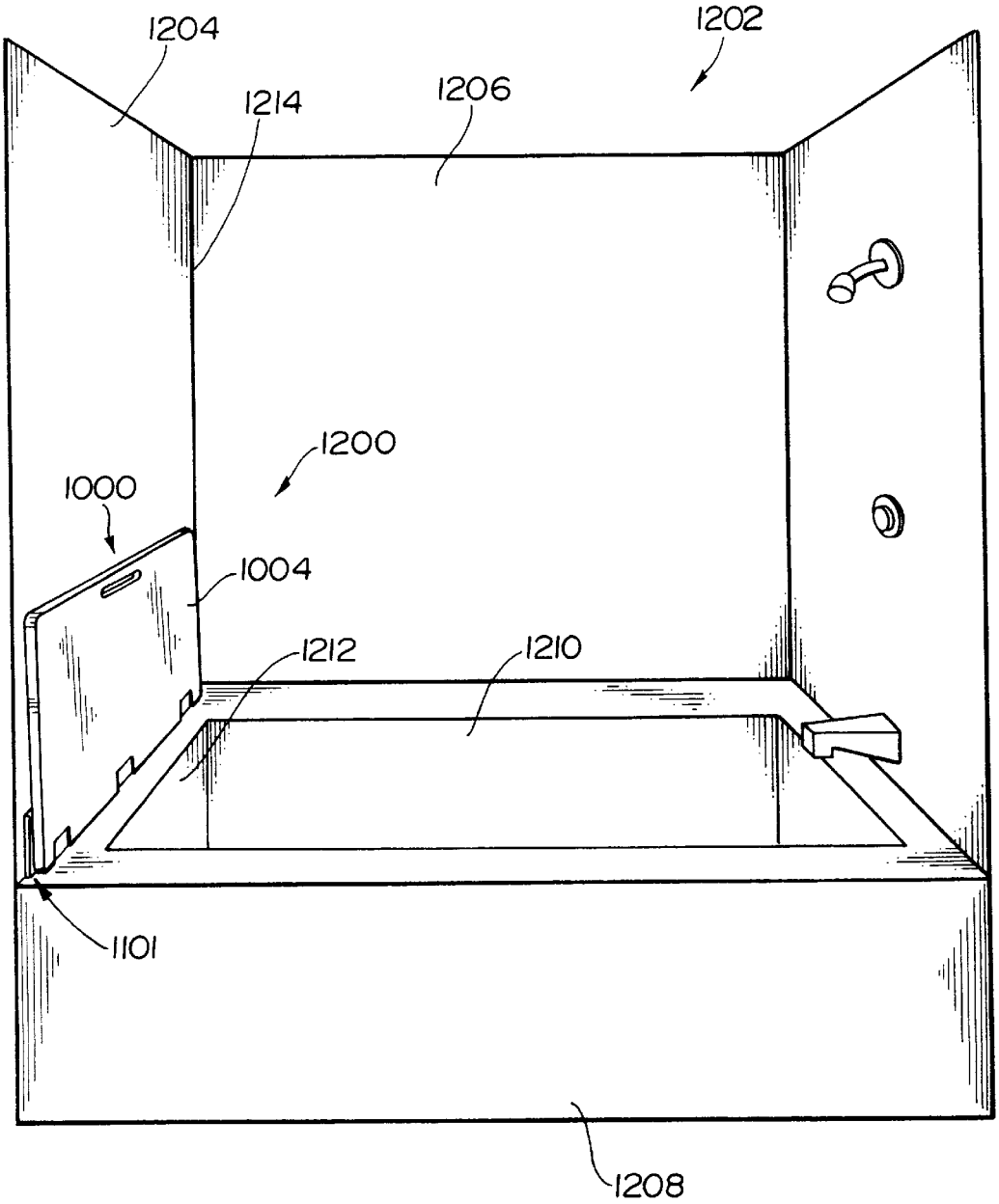
FIG. 24 is a perspective view of the bathtub and shower seat according to the third embodiment of the invention, installed in a bathtub with shower stall environment, in the storage position.

As shown in FIG. 22, a panel member 1000 is provided a first side surface 1002, an opposite second side surface 1004 (see FIG. 24, a first end 1006, a second end 1008, a first edge side surface 1010 extending between the first end and the second end, and a second edge side surface 1012 extending between the first end and the second end opposite to the first edge surface. The panel member defines a first notch 1014 in the first edge surface and a second notch 1016 in the first edge surface. A first hinge tab portion 1018 is positioned in the first notch. A second hinge tab portion 1020 is positioned in the second notch.

Figure 27:
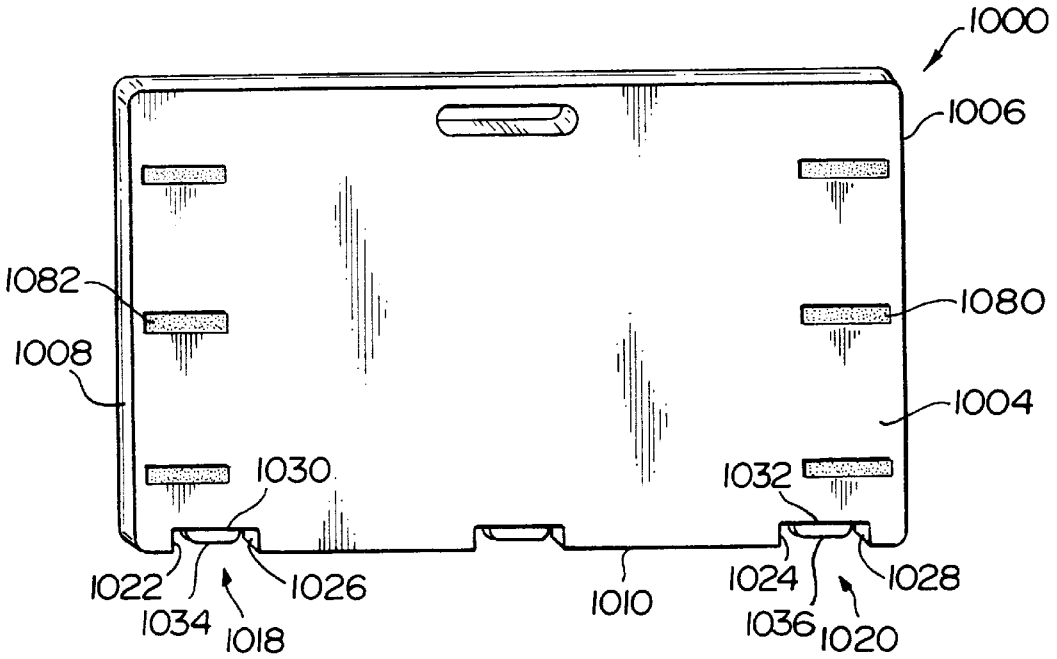
FIG. 27 is a bottom pictorial representation of the panel member according to the third embodiment.

As shown best in FIG. 27, each notch is defined by a notch first side surface 1022, 1024, an oppositely facing notch second side surface, 1026, 1028 and a notch back surface 1030, 1032. Each hinge tab portion extends from the notch back surface and is spaced apart from the notch first side surface and the notch second side surface.

Figure 25:
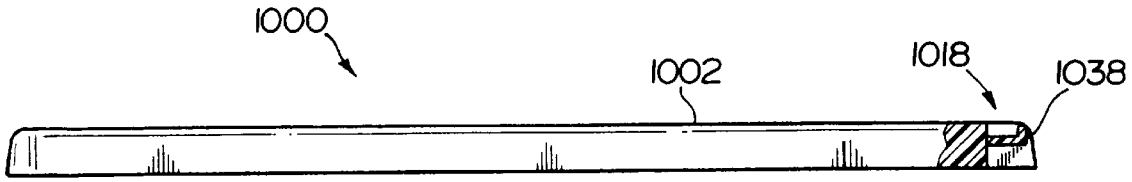
FIG. 25 is a side sectional view of the panel member according to the third embodiment of the invention, to better illustrate the hinge tab.
Figure 28:
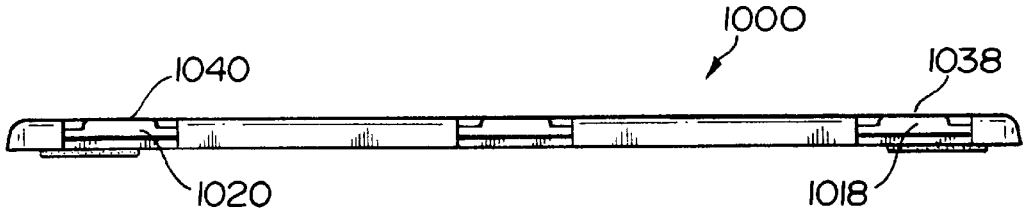
FIG. 28 is a back pictorial representation of the panel member according to the third embodiment.

Preferably, each hinge tab portion has a first end connected to the notch back surface and a second end 1034, 1036 opposite from the first end which is in a recessed position with respect to the first edge surface 1010 of the panel member. Preferably, each hinge tab portion 1018, 1020 has a lip 1038, 1040 adjacent to its second end which extends toward the first side surface 1002 of the panel member (See FIGS. 22, 25, 28).

Figure 30:
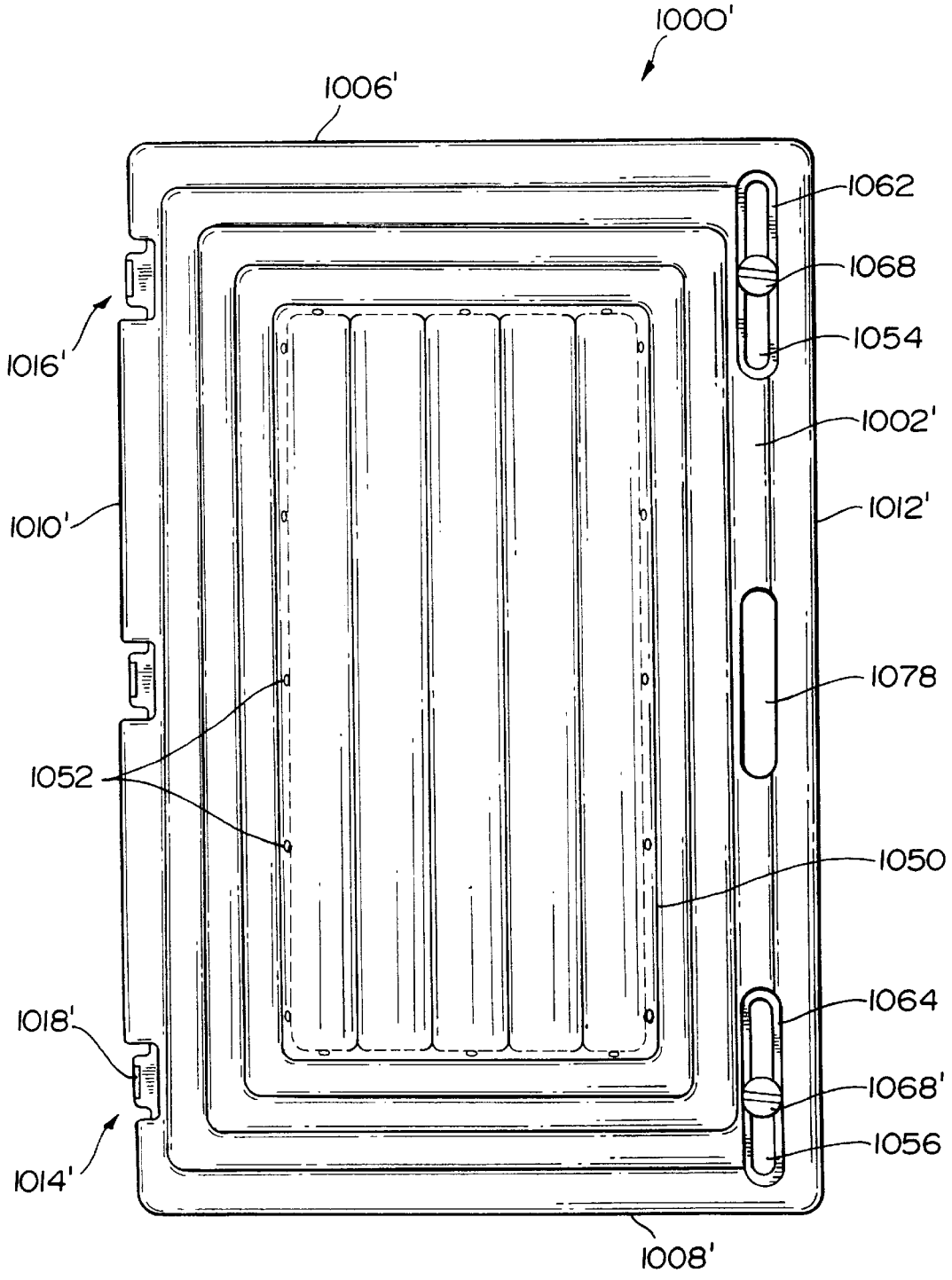
FIG. 30 is a top plan view of a preferred panel member according to the third embodiment.

Preferably, first side surface of the panel member forms a seating surface (see also FIG. 30). The first notch is preferably spaced apart from the first end surface of the panel member at a predetermined distance and the second notch is spaced apart from the second end surface of the panel member at a substantially equal distance. The panel member preferably has a generally rectangular configuration with a length as measured between the first end and the second end, a width as measured between the first edge surface and the second edge surface, and a thickness as measured from the first side surface to the second side surface. The length is greater than the width. The width is greater than the thickness. The first hinge tab portion and the second hinge tab portion each preferably has a longitudinal axis which is positioned perpendicular to the length of the panel member and is spaced between the first side surface and the second side surface. (See FIG. 25) The lip on each hinge tab portion runs preferably parallel to the length of the panel member (See FIG. 22).

Figure 33:
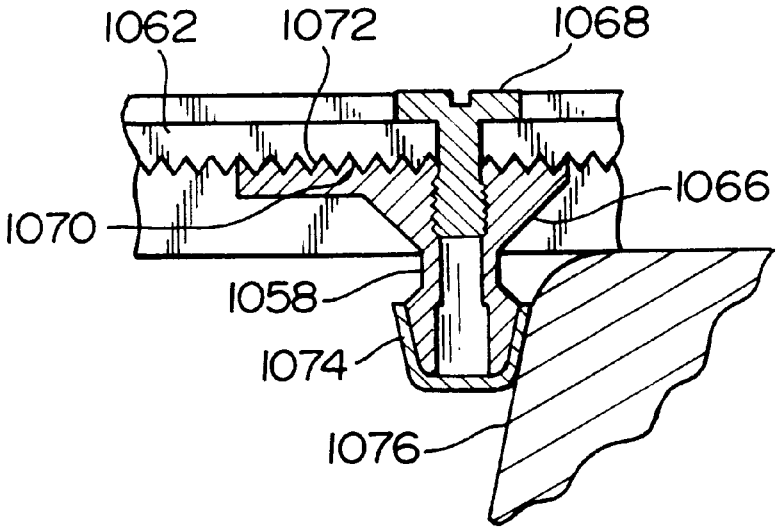
FIG. 33 is a side sectional view of the portion of the panel member shown in FIG. 32
Figure 34:
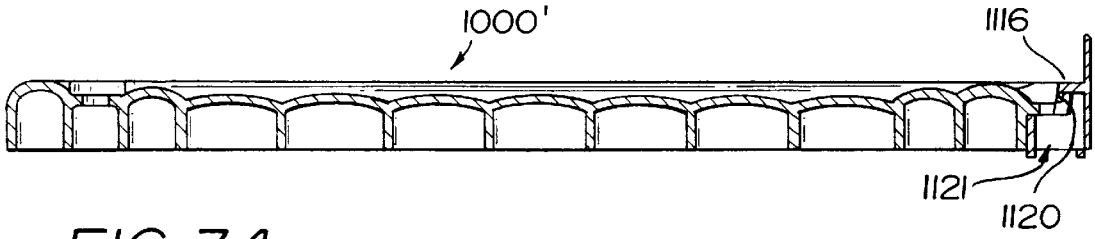
FIG. 34 is a side sectional view of the panel-hinge assembly shown in the use position.
Figure 35:
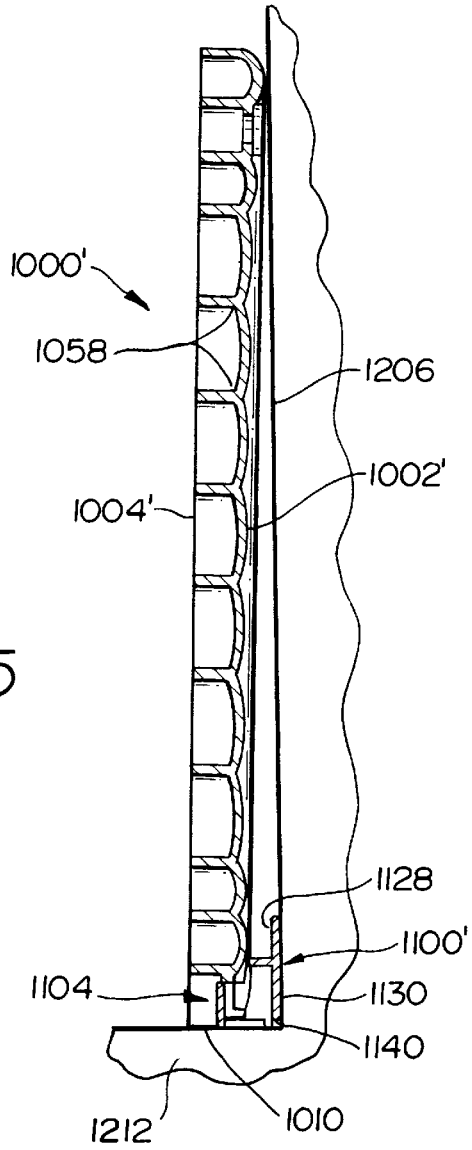
FIG. 35 is a side sectional view of the panel-hinge assembly shown in the storage position.

FIGS. 30–35 illustrate a further preferred panel member 1000'. With reference to FIG. 30, the panel member 1000' has a generally rectangular configuration with a length as measured between a first end 1006' and a second end 1008', a width as measured between a first edge surface 1010' and a second edge surface 1012', and a thickness as measured from a first side surface 1002' to a second side surface 1004"(see FIG. 31). The length is greater than the width. The width is greater than the thickness. A first notch 1014' is formed in the first edge surface and a second notch 1016' is formed in the first edge surface. A first hinge tab portion 1018' is positioned in the first notch. and a second hinge tab portion 1020' is positioned in the second notch. As best shown by FIG. 35, the first edge surface 1010' forms an angle in the range of about 85 degrees to about 89 degrees with respect to a cross sectional plane through the panel member 1000' between the first side surface 1002" and the second side surface so that the panel member will lean toward the first side surface when resting on the first edge surface. In the illustrated embodiment, this is accomplished by providing the panel member with a width as measured between the first edge surface and the second edge surface which is greater across the second side surface than across the first side surface.

It is also preferred to provide the panel member 1001' with drain holes. With reference to FIG. 30, the first side surface 1002' defines a central depression 1050 and a plurality of drain holes 1052 extend from the first side surface to the second surface around the central depression. In the illustrated embodiment, the central depression 1050 is generally rectangularly shaped and the plurality of drain holes 1052 are peripherally positioned around the central depression.

Figure 31:
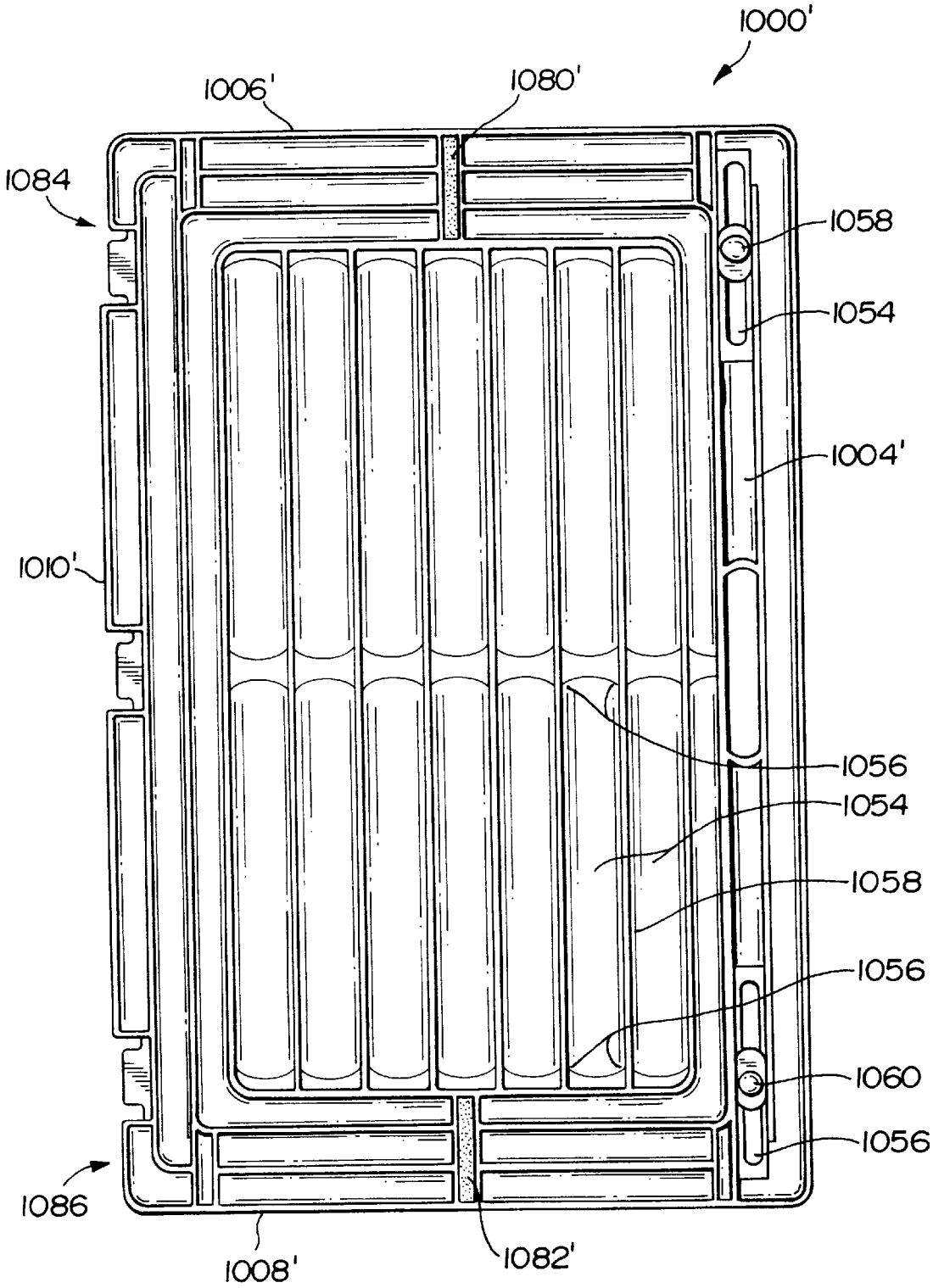
FIG. 31 is a bottom plan view of the panel member shown in FIG. 30.

With reference to FIG. 31, the panel member 1001' the second side surface 1004' preferably forms a bottom side surface which defines a plurality of panel-shaped recesses 1054 which occupy a substantial portion of the bottom surface. Each of the panel-shaped recesses has rounded corners 1056. The rounded corners facilitate cleaning. Preferably, each of the panel-shaped recesses is generally rectangularly shaped and has radiussed corners. More preferably, each of the panel-shaped recesses has inner edges 1058 and the inner edges are also rounded. See FIG. 35.

Figure 32:
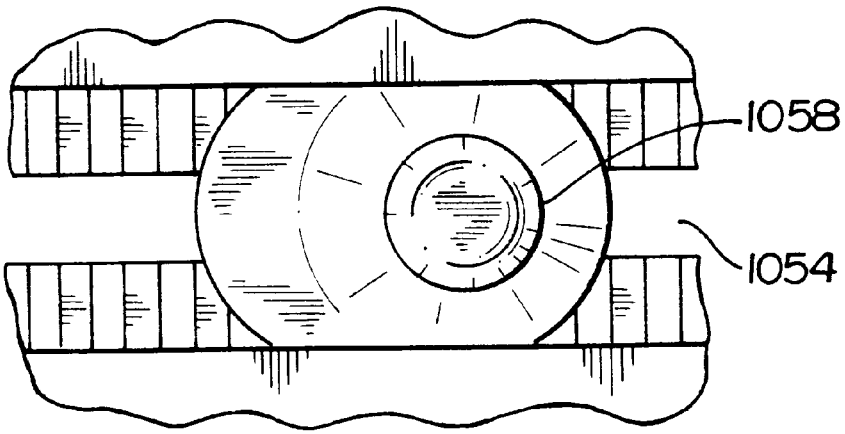
FIG. 32 is a detailed view of a portion of the panel member shown in FIG. 31.

As shown in FIG. 31, the panel member 1000' further preferably defines a pair of elongated slots 1054, 1056 extending from the top side surface to the bottom side surface and through the panel member. The pair of elongated slots is positioned adjacent to the second edge side surface 1012' and each slot is elongated in the direction of the length of the panel member. With reference to FIGS. 31–33, a pair of posts 1058, 1060 are positioned in the elongated slots, one post per slot. The posts extend generally normally from the bottom side of the panel member. Each post being releasably fastened at a desired position in its respective slot.

As illustrated in FIG. 30, the panel member 1001' preferably further defines a generally inwardly extending flange 1062, 1064 positioned around an outer periphery of each slot. As shown best in FIG. 33, each post comprises a post member 1066 having an upper end and a lower end and defining a threaded axial bore extending from the upper end and a screw 1068 having a shaft element and a head element with the shaft element engaging the threaded bore. The post is positioned in the elongated slot with the generally inwardly extending flange being contacted by the head element of the screw and the upper end of the post. The head element of the screw is preferably at least partially recessed in the elongated slot. The upper end of the post member 1066 preferably defines a set of parallel grooves 1070 which are engaged in a desired positioned with a reciprocal set of parallel grooves 1072 defined by a lower face of the inwardly extending flange 1062. The reciprocal set of parallel grooves provides multiple positions for engaging the upper end of the post. The post element of each post preferably extends generally normally from bottom side of the panel member and is further provided with an elastomeric outer surface 1074 to frictionally engage a bathtub wall 1076. The posts prevent lateral movement of the front end of the panel when the seat is in use.

The panel member 1001' preferably further defines a third slot 1078 between the pair of elongated slots 1054 and 1056. The third slot is positioned parallel to the pair of elongated slots and extends through the panel member to serve as a handle.

Figure 29:
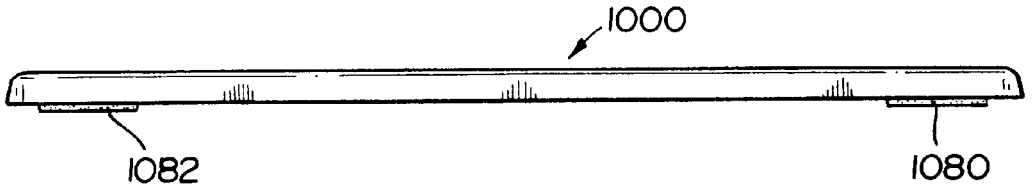
FIG. 29 is a front pictorial representation of the panel member according to the third embodiment.

With reference to FIG. 27 the panel member 1000 is preferably further provided at least a first piece 1080 of skid resistant elastomeric material is mounted to the second side surface of the panel member adjacent to the first end 1006 of the panel member and at least a second piece 1082 of skid resistant elastomeric material is mounted to the second side surface of the 10 panel member adjacent to the second end 1008 of the panel member. In the illustrated embodiment, strips of elastomeric material are used. With reference to FIG. 29, the strips protrude from the second side surface so as to engage the upper bathtub wall and help prevent slippage when the panel is in the use position. With reference to FIG. 31, the panel 1000' is similarly provided with pieces 1080', 1082' of skid resistant material. In this illustrated embodiment, the pieces are in the form of pads which are mounted in recesses in the bottom side of the panel member. Preferably, a plurality of skid resistant pieces are positioned on the bottom surface of the panel member adjacent to each end.

As best shown in FIG. 31, the panel member 1001' is preferably further provided with cutouts near the rear corners to accommodate a shower. The panel member is formed so as to define a first stepdown portion 1084 in the first edge surface 1010' and a second stepdown portion 1086 in the first edge surface. The first stepdown portion extends from the first end 1006' for a predetermined distance. The second stepdown portion 1086 extends from the second end for substantially the same predetermined distance. the width of the panel member as measured between the second edge surface 1012' and the first edge surface 1010' at the stepdown portions is less than the width of the panel member as measured between the second edge surface and the first edge surface at a position between the stepdown portions. The stepdown portions provide additional shower curtain clearance adjacent to the first end of the first edge surface and the second end of the first edge surface. Generally speaking, this additional clearance is in the range of 0.3 to about 2 cm less than the maximum width of the panel member.

Figure 26:
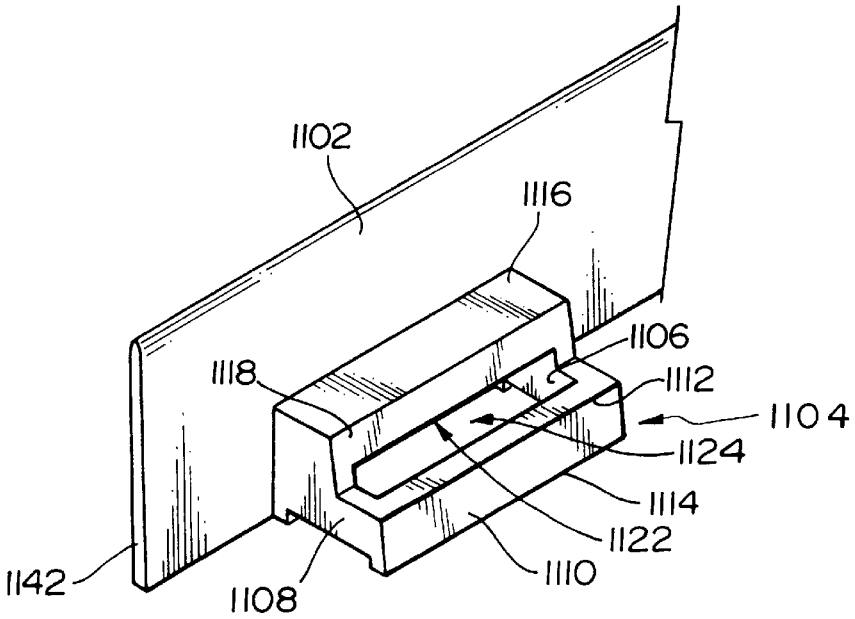
FIG. 26 is an elevated view of a portion of the hinge member for receiving the tab according to the third embodiment of the invention.

With reference to FIG. 22, a hinge member 1100 is formed from a base member 1102 and a housing 1104 mounted to the base member. With reference to FIG. 26. The housing 1104 has a first side wall 1106 extending generally normally from the base member, a second side wall 1108 extending from the base member positioned parallel to the first side wall and spaced apart therefrom, and an end wall 1110 connecting the first side wall to the second side wall and positioned generally parallel to the base member. The end wall has an upper end 1112 and a lower end 1114. The first side wall, the second side wall, and the end wall together partially define a generally parallel-walled chamber having an upper end and a lower end. A roof member 1116 extends generally normally from the base member in covering relationship with the upper end of the chamber. The roof member has an inner end attached to the base member and an outer end 1118 spaced above the upper end 1112 of the end wall and between the upper end of the end wall and the base member 1102. The roof member is preferably connected to the first side wall and the second side wall for structural stability. With reference to FIG. 34, the roof member 1116 has a lip 1120 near the outer end extending downwardly toward the chamber 1121. With reference again to FIG. 26, the lip has a lower end 1122 and a slot 1124 is formed between the lower end 1124 of the lip and the upper end 1112 of the end wall.

With reference to FIG. 22, the base member 1102 is preferably formed from a longitudinally elongated hinge member plate portion 1126. With reference to FIG. 35, the hinge member plate portion has a first generally planar face 1128 and a second generally planar face 1130 opposite from the first generally planar face. The housing 1104 protrudes from the first generally planar face of the hinge member plate portion.

The hinge member as shown in FIG. 22 preferably further comprises at least one second housing 1105 protruding from the first generally planar face of the hinge member plate portion. The housing 1105 is preferably identical to the housing 1104. The housing 1104 is preferably positioned at a first distance from a first end 1132 of the longitudinally elongated plate portion, and the second housing 1105 is preferably positioned at substantially the same distance from the second end 1134 of the longitudinally elongated plate portion. The housings provide a plurality of hinge element receiving structures longitudinally spaced apart along the front side surface of the base member, each having an upwardly and outwardly oriented opening.

The longitudinally elongated base member can be characterized as having a front side surface, an oppositely facing back side surface, a top edge, an opposite bottom edge, a first end, and a second end. The base member has a generally rectangular configuration with a length as measured between the first end and the second end, a width as measured between the top edge and the bottom edge, and a thickness as measured from the front side surface to the back side surface. The length is greater than the width. The width is greater than the thickness.

The longitudinally elongated base member preferably has a beveled edge 1140 between the back surface and the bottom edge (see FIG. 35), a beveled surface 1142 between the back surface and the first end (see FIG. 26), and a beveled surface 1144 between the back surface and the second end. The beveled edges extend for the length of the back surface along each of the bottom edge, the first end, and the second end and provide accommodation for installing the base member over preexisting caulking beads. The beveled edges are defined by an angled surface extending between the back surface and each of the bottom edge, the first end, and the second end.

As best shown by FIGS. 34 and 35, when the hinge member 1100' is joined with the panel member 1000', the first hinge tab portion of the panel member is positioned in the slot defined in the first housing. The second hinge tab portion is similarly positioned in the slot defined in the second housing (see FIG. 23, for example). The first side wall and the second side wall of each housing is positioned in a respective notch of the panel member;

The panel member is moveable from a first position in which the lip on each hinge tab is engaged by the lip of a housing to prevent the panel member from being separated from the hinge member (see FIG. 34) to a second position in which the lip on each hinge tab is disengaged from the lip of the housing to permit the panel member to be separated from the hinge member (see FIG. 35). Preferably, each housing is closely received by a notch to nearly eliminate lateral movement between the panel member and the hinge member (See FIG. 23), and at least a portion of the back edge of the panel member is positioned closely adjacent to the front side surface of the hinge member.

As shown by FIG. 22, the base member has a length which is greater than the length of the panel member and end portions which protrude past the first end and the second end of the panel member. This relationship assures that the panel member will have clearance from the shower stall side walls when mounted to a previously installed hinge member.

For esthetics, it is preferred that the roof member has an upper surface which is substantially flat with the upper surface of the panel member when the panel member is in the first position. See FIG. 23.

Figure 23:
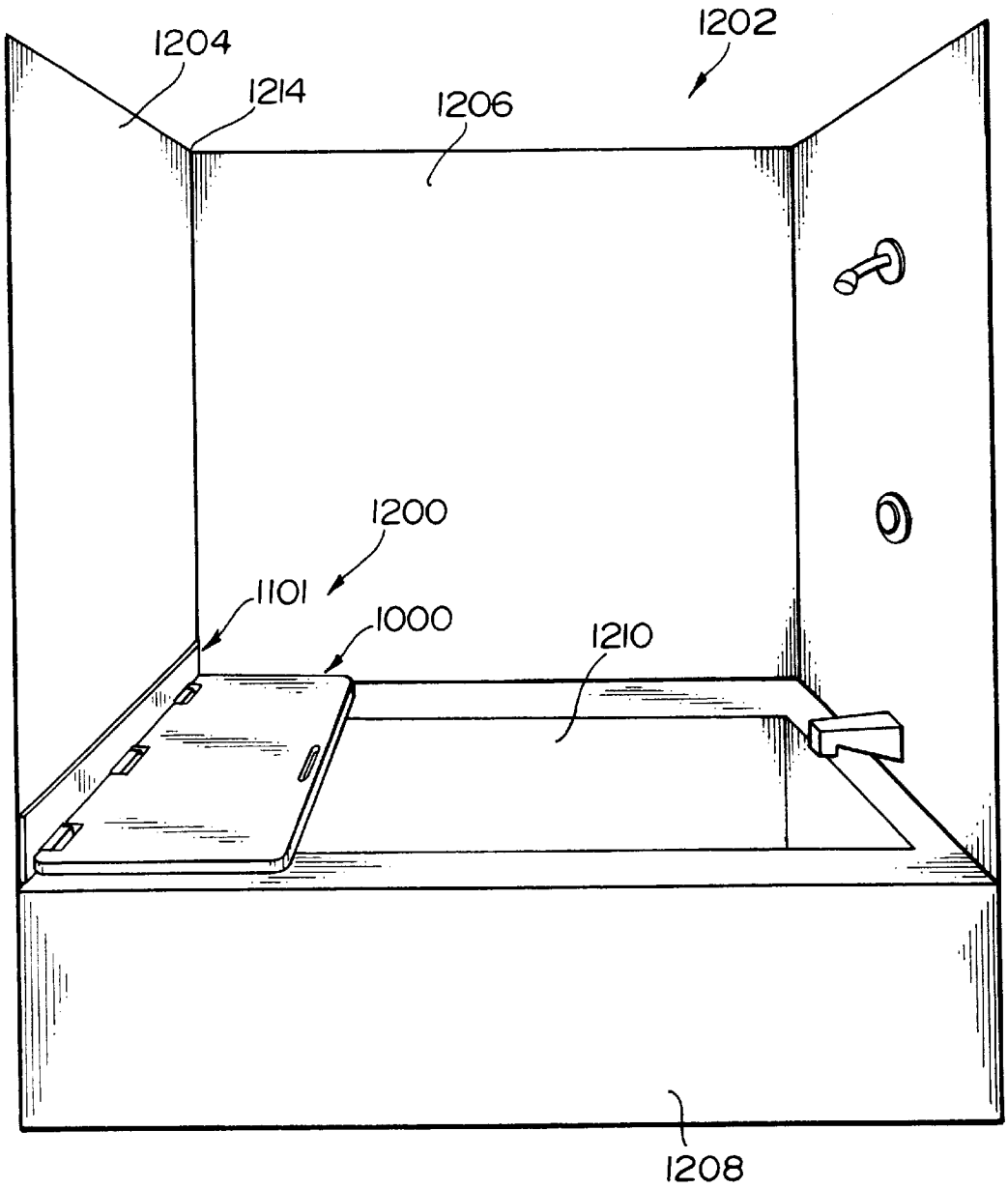
FIG. 23 is a perspective view of the bathtub and shower seat according to the third embodiment of the invention, installed in a bathtub with shower stall environment, in the use position.

With reference to FIGS. 23 and 24, seating unit 1200 is provided for a bathtub 1202 that is provided with a rear splash wall 1204 and a side splash wall 1206. The bathtub has a first side wall 1208 having an upper end, a second side wall 1210 having an upper end, and a back end wall 1212 having an upper end and connecting the first side wall with the second side wall. The rear splash wall extends upwardly from the upper end of the back end wall of the bathtub and the side splash wall extends upwardly from the first side wall of the bathtub and is connected to the rear splash wall by a corner 1214. The seating unit comprises a panel member 1000 and a means 1101 for pivotally connecting the panel member to the rear splash wall at a location closely adjacent to the upper end of the back end wall so that the panel member will pivot from a storage position (as shown by FIG. 24) to a use position (as shown by FIG. 23). The panel member has a length sufficient to simultaneously contact the upper end of the first side wall and the upper end of the second side wall and a width sufficient to accommodate a sitting person. The means for pivotally connecting the panel member comprises a hinge strip having a length which is longer than the length of the panel member so that the panel member is spaced from the side splash wall for free pivoting motion.

As show in FIG. 23, the downward travel of the panel member is limited by the upper end of the first side wall of the bathtub, the upper end of the second side wall of the bathtub, and the upper end of the back end wall of the bathtub when the panel member is in the use position. Preferably, strips or pads of elastomeric material, which are mounted to the panel member as described hereinabove, are positioned between the panel member and the upper end of the first side wall of the bathtub and the upper end of the second side wall of the bath tub when the seating unit is in the use position. The elastomeric strips, in conjunction with the means for pivotally connecting the panel member to the rear splash wall, resist skidding movement of the seating unit when in the use position.

As shown in FIG. 35, the panel member 1000' is preferably positioned adjacent to the rear splash wall and is in contact with the upper end of the back end wall 1212 when the panel member is in the storage position.

As previously described, a rear edge of the panel member is preferably formed so as to cause the panel member to lean against the rear splash wall when the panel member is in the storage position. A leaning angle in the range of 1 to 5 degrees is preferred, and an angle of about 1.7 degrees has been used with good results. The leaning can be brought about by beveling the rear edge of the panel, for example, and configuring the hinge and tabs so that the rear edge will rest against the top of the bathtub back end wall when the panel is in the storage position.

The seating unit is preferably provided with security posts as previously described to contact the walls of the bathtub and to substantially eliminate lateral movement of the front edge of the panel member when the panel member is in the use position. Providing the security posts with an elastomeric outer surface to frictionally engage a side wall of the bathtub is preferred.

Providing the hinge strip has a rear face which has a bottom edge, a first side edge, and a second side edge, with each of the bottom edge, the first side edge, and the second side edge being beveled to facilitate installation of the hinge strip over a caulk bead is also preferred as is mounting the seating unit to the rear splash wall with double backed tape.

It is also preferred to provide step downs on the rear edge of the panel member as previously described to accommodate a shower curtain.

The seating unit is mounted by attaching the hinge strip to the rear splash wall with a first end of the hinge strip positioned in the comer and a lower edge of the hinge strip positioned on the upper end of the rear wall of the bathtub. The panel member is then pivotally attached to the hinge strip for pivotal movement from a storage position to a use position. Because the hinge strip is longer than the panel member, the panel member will not drag on the side splash wall when being moved from the storage to use position.

It is preferred that the panel member and hinge strip be constructed as hereinabove described so the panel member can be attached to the hinge strip simply by inserting the tabs into the slots. Where the slots open upwardly and laterally from the boxes, the tabs can be inserted downwardly through the slots to pivotally attach the panel member to the hinge strip.

Although the hinge strip is preferably attached to the rear splash wall with double backed tape, other techniques can be used if desired. For example, the hinge strip can be attached to the rear splash wall with adhesive or by screws with satisfactory results.

While certain preferred embodiments of the invention have been described herein, the invention is not to be construed as being so limited, except to the extent that such limitations are found in the claims.

What is claimed is:

1. Apparatus comprising a panel member having an upper side surface, an opposite bottom side surface, a first end, a second end, a back edge side extending between the first end and the second end, and a front edge surface extending between the first end and the second end opposite to the first edge surface, said panel member defining a first notch in the back edge surface and a second notch in the back edge surface, said panel member having a first hinge tab portion positioned in the first notch, and a second hinge tab portion positioned in the second notch; each hinge tab portion having a first end attached to the panel member and a second end extending from the panel member and positioned in the notch, and further having an upwardly extending lip adjacent to the second end;

a hinge member formed from a base member having a front side surface, a first housing mounted to the base member front side surface, and a second housing mounted to the base member front side surface, each said housing having a first side wall extending generally normally from the base member front side surface, a second side wall extending from the base member front side surface positioned parallel to the first side wall and spaced apart therefrom, and an end wall connecting the first side wall to the second side wall and positioned generally parallel to the base member front side surface, said end wall having an upper end and a lower end; said first side wall, said second side wall, and said end wall together partially defining a generally parallel-walled chamber having an upper end and a lower end; and a roof member extending generally normally from the base member front side surface in covering relationship with the upper end of the chamber, said roof member having an inner end attached to the base member and an outer end spaced above the upper end of the end wall and between the upper end of the end wall and the base member, said roof member having a lip near the outer end extending downwardly toward the chamber, said lip having a lower end, a slot being formed between the lower end of the lip and the upper end of the end wall;

wherein the first hinge tab portion is positioned in the slot defined in the first housing and the second hinge tab portion is positioned in the slot defined in the second housing, with the first side wall and the second side wall of each housing being positioned in a respective notch of the panel member;

wherein said panel member is moveable from a first position in which the lip on each hinge tab is engaged by the lip of a housing to prevent the panel member from being separated from the hinge member, to a second position in which the lip on each hinge tab is disengaged from the lip of the housing to permit the panel member to be separated from the hinge member.

2. Apparatus as in claim 1 wherein each housing is closely received by a notch to nearly eliminate lateral movement between the panel member and the hinge member.

3. Apparatus as in claim 2 wherein at least a portion of the back edge of the panel member is positioned closely adjacent to the front side surface of the hinge member.

4. Apparatus as in claim 3 wherein the panel member has a length as measured between the first end and the second end and the base member has a length which is greater than the length of the panel member and end portions which protrude past the first end and the second end of the panel member.

5. Apparatus in claim 4 wherein the roof member has an upper surface which is substantially flat with the upper surface of the panel member when the panel member is in the first position.

* * * * *